US011819121B2

(12) United States Patent
Olsen

(10) Patent No.: US 11,819,121 B2
(45) **Date of Patent: *Nov. 21, 2023**

(54) LOCKING MECHANISM FOR A FOLDING TABLE

(71) Applicant: LIFETIME PRODUCTS, INC., Clearfield, UT (US)

(72) Inventor: Brian Olsen, Roy, UT (US)

(73) Assignee: LIFETIME PRODUCTS, INC., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/057,840

(22) Filed: Nov. 22, 2022

(65) Prior Publication Data

US 2023/0084561 A1 Mar. 16, 2023

Related U.S. Application Data

(63) Continuation of application No. 17/348,505, filed on Jun. 15, 2021, now Pat. No. 11,517,105.

(51) Int. Cl.
*A47B 3/087* (2006.01)
*A47B 3/00* (2006.01)
(Continued)

(52) U.S. Cl.
CPC ..... *A47B 3/087* (2013.01); *A47B 3/002* (2013.01); *A47B 3/083* (2013.01); *A47B 3/0912* (2013.01);
(Continued)

(58) Field of Classification Search
CPC ..... A47B 3/083; A47B 3/002; A47B 13/02; A47B 2230/07
See application file for complete search history.

(56) References Cited

U.S. PATENT DOCUMENTS 3,410,232 A 11/1968 Krueger
6,912,961 B2 7/2005 Winter et al.
(Continued)

FOREIGN PATENT DOCUMENTS

FR 2573467 A1 5/1986
FR 2807632 A1 10/2001

OTHER PUBLICATIONS

International Search Report and Written Opinion dated Aug. 31, 2020, in related PCT Application No. PCT/US2020/041414.
(Continued)

*Primary Examiner* — Daniel J Rohrhoff
(74) *Attorney, Agent, or Firm* — Maschoff Brennan

(57) ABSTRACT

A foldable table may include a tabletop and legs that are movable between an extended position and a collapsed position. The tabletop may include a first section and a second section that are connected by a hinge assembly. A locking mechanism may be sized and configured to lock the hinge assembly in a fixed position. The locking mechanism may include a locking member, and the locking member may be a unitary, one-piece structure. The locking member may be rotatably connected to a connector of the hinge assembly. The locking member may be connected to a locking structure that is movable between a locked position and an unlocked position. The locking member may be sized and configured to bias the locking structure into the locked position.

20 Claims, 14 Drawing Sheets

(51) Int. Cl.

| | |
|---|---|
| ***A47B 3/083*** | (2006.01) |
| ***A47B 3/091*** | (2006.01) |
| ***A47B 3/10*** | (2006.01) |
| ***A47B 13/02*** | (2006.01) |

(52) U.S. Cl.

CPC ..... *A47B 3/10* (2013.01); *A47B 13/02* (2013.01); *A47B 2003/008* (2013.01); *A47B 2230/07* (2013.01)

(56) References Cited

U.S. PATENT DOCUMENTS

| | | | | |
|---|---|---|---|---|
| 6,968,789 | B2 | 11/2005 | Baik et al. | |
| 7,051,662 | B2 | 5/2006 | Shenghao et al. | |
| 7,059,254 | B2 | 6/2006 | Strong et al. | |
| 7,096,799 | B2 | 8/2006 | Strong et al. | |
| 7,111,563 | B2 | 9/2006 | Strong | |
| 7,278,361 | B2 | 10/2007 | Zhurong et al. | |
| 7,331,297 | B2 | 2/2008 | Strong et al. | |
| 7,461,601 | B2 | 12/2008 | Jin et al. | |
| 7,469,646 | B2 | 12/2008 | Baik et al. | |
| 7,475,642 | B2 | 1/2009 | Shenghao et al. | |
| 7,475,643 | B2 | 1/2009 | Haney et al. | |
| 7,475,644 | B2 | 1/2009 | Strong et al. | |
| 7,640,870 | B2 | 1/2010 | Strong et al. | |
| 7,644,667 | B2 | 1/2010 | Strong et al. | |
| D619,831 | S | 7/2010 | Branch | |
| 7,905,185 | B2 | 3/2011 | Peery et al. | |
| D640,487 | S | 6/2011 | Bennett | |
| 7,971,930 | B2 | 7/2011 | Larsen et al. | |
| 8,006,630 | B2 | 8/2011 | Strong et al. | |
| 8,033,228 | B2 | 10/2011 | Haney et al. | |
| 8,156,875 | B2 | 4/2012 | Neunzert et al. | |
| D658,912 | S | 5/2012 | Winter et al. | |
| D659,450 | S | 5/2012 | Winter et al. | |
| 8,166,894 | B1 | 5/2012 | Branch et al. | |
| D662,736 | S | 7/2012 | Peery et al. | |
| D662,738 | S | 7/2012 | Winter et al. | |
| D667,659 | S | 9/2012 | Winter et al. | |
| D668,483 | S | 10/2012 | Bennett | |
| 8,302,541 | B2 | 11/2012 | Haney et al. | |
| D671,773 | S | 12/2012 | Johnson et al. | |
| D671,775 | S | 12/2012 | Clegg et al. | |
| D671,776 | S | 12/2012 | Clegg et al. | |
| D672,175 | S | 12/2012 | Peery et al. | |
| 8,342,107 | B2 | 1/2013 | Mower et al. | |
| 8,347,795 | B2 | 1/2013 | Peery et al. | |
| 8,397,652 | B2 | 3/2013 | Peery et al. | |
| 8,397,653 | B2 | 3/2013 | Ashby et al. | |
| 8,408,146 | B2 | 4/2013 | Peery et al. | |
| D681,982 | S | 5/2013 | Clegg et al. | |
| D682,586 | S | 5/2013 | Clegg et al. | |
| D683,985 | S | 6/2013 | Nye et al. | |
| D688,496 | S | 8/2013 | Bennett | |
| 8,534,205 | B1 | 9/2013 | Johnson et al. | |
| 8,544,393 | B2 | 10/2013 | Branch et al. | |
| 8,555,789 | B2 | 10/2013 | Jin et al. | |
| 8,555,790 | B2 | 10/2013 | Winter et al. | |
| 8,555,791 | B2 | 10/2013 | Jin et al. | |
| 8,578,863 | B2 | 11/2013 | Peery et al. | |
| 8,578,865 | B2 | 11/2013 | Haney et al. | |
| D696,882 | S | 1/2014 | Clegg et al. | |
| 8,622,007 | B2 | 1/2014 | Peery et al. | |
| D700,465 | S | 3/2014 | Johnson et al. | |
| 8,683,929 | B2 | 4/2014 | Peery et al. | |
| 8,720,990 | B2 | 5/2014 | Boydston | |
| 8,726,817 | B2 | 5/2014 | Bennett et al. | |
| 8,746,155 | B2 | 6/2014 | Haney et al. | |
| 8,757,069 | B2 | 6/2014 | Peery et al. | |
| D708,462 | S | 7/2014 | Nye et al. | |
| D715,081 | S | 10/2014 | Bennett | |
| 8,857,349 | B2 | 10/2014 | Peery et al. | |
| 8,904,943 | B2 | 12/2014 | Jin et al. | |
| 8,943,982 | B2 | 2/2015 | Peery et al. | |
| D727,074 | S | 4/2015 | Johnson et al. | |
| 8,997,663 | B2 | 4/2015 | Peery et al. | |
| D734,081 | S | 7/2015 | Johnson et al. | |
| 9,101,209 | B2 | 8/2015 | Bennett et al. | |
| D739,672 | S | 9/2015 | Johnson et al. | |
| 9,138,050 | B2 | 9/2015 | Peery et al. | |
| 9,173,482 | B2 | 11/2015 | Peery et al. | |
| 9,192,229 | B2 | 11/2015 | Peery et al. | |
| 9,192,230 | B2 | 11/2015 | Clegg et al. | |
| D748,418 | S | 2/2016 | Johnson et al. | |
| 9,277,808 | B2 * | 3/2016 | Cai | A47B 3/087 |
| 9,307,831 | B2 | 4/2016 | Peery et al. | |
| 9,351,563 | B2 | 5/2016 | Bennett et al. | |
| D759,411 | S | 6/2016 | Johnson et al. | |
| 9,486,076 | B2 | 11/2016 | Peery et al. | |
| 9,532,644 | B2 | 1/2017 | Nye et al. | |
| 9,549,612 | B2 | 1/2017 | Peery et al. | |
| 9,591,918 | B2 | 3/2017 | Nye et al. | |
| 9,642,459 | B2 | 5/2017 | Peery et al. | |
| 9,661,916 | B2 | 5/2017 | Peery et al. | |
| 9,730,514 | B2 | 8/2017 | Peery | |
| 9,763,513 | B2 | 9/2017 | Cai et al. | |
| 9,763,517 | B2 | 9/2017 | Peery et al. | |
| 9,848,699 | B2 | 12/2017 | Peery et al. | |
| D863,853 | S | 10/2019 | Johnson et al. | |
| D864,637 | S | 10/2019 | Johnson et al. | |
| 11,517,105 | B1 * | 12/2022 | Olsen | A47B 3/087 |
| 2004/0094076 | A1 * | 5/2004 | Jin | A47B 3/087 108/132 |
| 2004/0187749 | A1 * | 9/2004 | Zhurong | A47B 3/087 108/130 |
| 2004/0188749 | A1 | 9/2004 | Chang et al. | |
| 2005/0274302 | A1 * | 12/2005 | Jin | A47B 3/087 108/126 |
| 2013/0233210 | A1 * | 9/2013 | Jin | A47B 3/0818 108/166 |
| 2014/0208992 | A1 | 7/2014 | Cai et al. | |
| 2015/0020716 | A1 * | 1/2015 | Tsai | A47B 3/087 108/130 |
| 2015/0282606 | A1 * | 10/2015 | Tsai | A47B 13/083 29/428 |
| 2016/0183673 | A1 * | 6/2016 | Cai | A47B 3/0912 248/188 |
| 2017/0013956 | A1 * | 1/2017 | Tsai | A47B 13/083 |
| 2020/0214440 | A1 | 7/2020 | Johnson et al. | |
| 2021/0007474 | A1 | 1/2021 | Nye | |

OTHER PUBLICATIONS

International Search Report and Written Opinion dated Sep. 29, 2022, in related PCT Application No. PCT/US2022/033298.
U.S. Appl. No. 17/348,564, filed Jun. 15, 2021.
U.S. Appl. No. 17/348,500, filed Jun. 15, 2021.

* cited by examiner

LOCKING MECHANISM FOR A FOLDING TABLE

CROSS-REFERENCE TO RELATED APPLICATIONS

The present application is a continuation application of U.S. patent application Ser. No. 17/348,505, filed Jun. 15, 2021, now U.S. Pat. No. 11,517,105, issued Dec. 6, 2022, which is incorporated by reference in its entirety.

BACKGROUND

Field

The present invention generally relates to furniture and, in particular, to tables that are capable of being folded and unfolded.

Description of Related Art

Many types of tables are well known and used for a variety of different purposes. For example, conventional tables may include legs that are pivotally attached to a tabletop and the legs may be movable between a use position in which the legs extend outwardly from the tabletop and a storage position in which the legs are folded against an underneath portion of the tabletop. Conventional tables with relatively large tabletops and folding legs are often referred to as "banquet tables" or "utility tables" and these types of tables are frequently used in assembly halls, banquet halls, convention centers, hotels, schools, churches, and other locations where large groups of people meet. When the tables are no longer needed, the table legs can be moved into the storage position and the tables may be moved or stored.

The tabletops of conventional banquet tables are relatively large. For example, many known banquet tables have a length between six and ten feet and a width between three and four feet. As a result, many conventional banquet tables require a large storage area even when the legs are in the storage position. This large storage area may be especially problematic for larger facilities, such as hotels, schools, and churches, because a considerable number of tables may have to be stored. Thus, a significant amount of storage space may be required. In addition, smaller facilities, such as restaurants, offices, and homes, may use one or more conventional banquet tables. These smaller facilities may use the tables less frequently, such as during special occasions and events. Conventional banquet tables, even when the legs are folded, are often too bulky and awkward to be conveniently stored at such smaller facilities. As a result, it is often necessary for both larger and smaller facilities to rent and/or borrow banquet tables when needed. Disadvantageously, renting and/or borrowing banquet tables can be inconvenient, time consuming, and costly. Further, renting and/or borrowing banquet tables may be difficult because transportation of the tables may be required.

Conventional banquet tables are often difficult to move or transport from one location to another because of the large size of the tables. For example, it may be problematic for a single person to move a conventional banquet table because of the length of the table. In addition, the length may preclude conventional banquet tables from being transported in the trunk or back seat of a typical passenger car. Accordingly, conventional banquet tables may have to be transported by a truck, trailer, or oversized vehicle, such as a sports utility vehicle. These and other factors may make conventional banquet tables time consuming and expensive to move.

It is also known to construct tables that are capable of being folded in half. In particular, many conventional fold-in-half tables include a tabletop with two sections pivotally connected by hinges. The sections of the tabletop usually have the same size and shape, and the hinges are typically located at the center of the tabletop. The sections of the tabletop may be moved between an unfolded or use position in which the sections of the tabletop are generally aligned in the same plane, and a folded or collapsed position in which the sections are positioned generally adjacent to each other for storage.

Disadvantageously, many conventional fold-in-half tables are unable to support a significant amount of weight. For example, the connection between the sections of the tabletop for many known fold-in-half tables is relatively weak, which may allow a portion of the tabletop to undesirably sag or slump. Additionally, the connection between the sections may be relatively frail and may break if a significant load or force is applied to the tabletop. In order to construct a stronger table, it is known to make the tabletop sections out of stronger and thicker materials. This may increase the weight of the tabletop, which may make the table more difficult to manufacture, ship, carry and move.

An additional shortcoming of many conventional fold-in-half tables is the tables may be relatively difficult and time consuming to use. For example, multiple steps may be required to set up and take down conventional fold-in-half tables. For instance, known fold-in-half tables may have to be unfolded, a first leg assembly moved from a storage to use position, a first cross brace moved into an extended position, a second leg assembly moved from a storage to use positions, a second cross brace moved into an extended position, a first locking ring moved into a locked position to secure the first leg assembly in a locked position, a second locking ring moved into a locked position to secure the second leg assembly in a locked position, and then a sliding bolt may be used to lock the tabletop in the use or unfolded position. Thus, numerous steps may be required before the table can be used. In addition, many of the same steps may be required to fold or store the table. For instance, the sliding bolt may have to be manually unlocked and the locking rings moved from the locked to the unlocked positions. The first and second braces may have to be moved from the extended positions to angled positions. The first and second leg assemblies may then be moved from the use to the storage positions, and then the tabletop may be folded into the collapsed position. Therefore, a number of steps may be required each time the table is desired to be used, moved and/or stored.

BRIEF SUMMARY

A need therefore exists for a table that eliminates or diminishes the disadvantages and problems described above.

One aspect is a table that may include a tabletop and one or more support structures or legs. The support structures may be movable between an extended or use position and a collapsed or storage position relative to the tabletop. When the support structures are in the use position, the support structures may extend outwardly and away from the tabletop. When the support structures are in the collapsed position, the support structures may be disposed generally parallel and at least proximate a lower portion of the tabletop. A portion of the support structures may contact or abut the lower portion of the tabletop when the support structures are in the collapsed position. Advantageously, when the support structures are in the use position, the table may support a wide variety of objects and the table may be used for different purposes. When the support structures are in the collapsed position, the table may be more easily moved, stored, and/or transported.

Another aspect is a table that may be a folding or fold-in-half table, and the table may include a tabletop that is capable of being folded and unfolded. For example, the tabletop may include two sections that are generally aligned in the same plane when the tabletop is in the unfolded or use position. The sections of the tabletop may be disposed in a generally parallel and/or adjacent configuration when the tabletop is in the folded position. The table may also include support structures movable between use and collapsed positions. Advantageously, if the table includes both a foldable tabletop and movable support structures, the table may be disposed and/or stored in a relatively compact area. The small size of the folding table may allow, for example, a single person to easily move and transport the table. In addition, the small size of the folding table may allow the table to be positioned in a relatively small area, such as the backseat or trunk of an automobile. The small size of the folding table may also decrease transportation and storage costs.

Still another aspect is a table that may include a tabletop constructed from plastic, and the plastic tabletop may be constructed using a blow-molding process. Advantageously, a blow-molded plastic tabletop may be lightweight, easily constructed, and/or formed into a desired size, shape, configuration, and/or design. The blow-molded plastic tabletop may also be generally weather resistant and temperature insensitive, which may allow the table to be used in a wide variety of locations and environments. In addition, the blow-molded plastic tabletop may be durable, long-lasting, and corrosion resistant. Further, the blow-molded plastic tabletop may be relatively strong and able to support a large amount of weight. The blow-molded plastic tabletop may form a structural member of the table, and the blow-molded plastic tabletop may include one or more features that are integrally formed as part of a unitary, one-piece construction.

Advantageously, a blow-molded plastic tabletop may be relatively strong because it may include opposing walls, and the opposing walls may be separated by a distance. For example, the opposing walls may be separated by a generally constant distance. The tabletop may also include one or more features, and the various features may be disposed in a generally uniform configuration and/or arrangement. The generally unfirm configuration and/or arrangement of the features may help create a tabletop with generally uniform properties such as strength, rigidity, and structural integrity. For instance, the tabletop may include a plurality of depressions, and the depressions may have a generally uniform configuration and/or the depressions may be arranged into a generally uniform pattern. In addition, because the blow-molded plastic tabletop may include a hollow interior portion, the blow-molded plastic tabletop may be lightweight. Thus, the blow-molded plastic tabletop may be lightweight, strong, and sturdy. The tabletop could also be formed from other suitable processes, such as injection molding, rotational molding, extrusion molding, vacuum forming, thermoforming, and the like. The tabletop could be constructed using other appropriate materials such as metal (including steel, aluminum, etc.), polymers, composites, natural materials, and the like.

Yet another aspect is a table that may include a frame attached to the tabletop. The frame may be sized and configured to allow the tabletop to be moved between the folded and unfolded positions. For example, the frame may include one or more elongated members, such as rails and/or siderails, and the siderails may extend along a length of the tabletop. The siderails may be disposed towards or located at least proximate the sides of the tabletop. The siderails may be connected to first and second sections of the tabletop, and the siderails may be pivotally connected by one or more hinge assemblies. For instance, a first portion of a siderail may be connected to a first section of the tabletop and a second portion of the siderail may be connected to a second section of the tabletop. A hinge assembly may connect the first and second portions of the siderail. Depending upon the size and configuration of the tabletop, any suitable number of siderails and/or elongated members may be used. In addition, the frame, elongated members, siderails, and/or hinge assemblies may have various shapes, sizes, configurations, and/or arrangements depending, for example, upon the intended use of the table.

Still yet another aspect is a table that may include a locking mechanism, and the locking mechanism may be locked and/or unlocked. For example, the locking mechanism may secure a portion of the table in a fixed position. In an exemplary embodiment, the locking mechanism may lock the tabletop in the use position. The locking mechanism may allow the tabletop to be disposed in a collapsed or storage position when the locking mechanism is unlocked. The locking mechanism may include a locking member and a locking structure, such as a locking pin. The locking member may bias the locking structure into the locked position. The locking member may include a release or control, and the release may unlock the locking mechanism. For example, when a force is applied to the release, such as a user pressing on the release, a first portion of the locking member may rotate and a second portion of the locking member may move the locking structure from the locked position to the unlocked position. Advantageously, the locking mechanism may simply and quickly lock the tabletop in a fixed position. In addition, the locking mechanism may easily and efficiently be unlocked. Further, the locking mechanism may be biased into the locked position, which may automatically lock the tabletop into a desired configuration.

A further aspect is a folding table that may include a locking mechanism, and the locking mechanism may include a locking member and a locking structure, such as a locking pin. The locking member may move the locking structure between locked and unlocked positions. In the locked position. the locking structure may secure the tabletop in a fixed position. In the unlocked position, the locking structure may allow the tabletop to be moved between folded and unfolded positions. The locking member may be a unitary, one-piece structure, and the locking member may be sized and configured to bias the locking structure into a locked position. The locking member may include a release that facilitates locking and/or unlocking of the locking mechanism. For example, the release may move the locking structure from the locked position to the unlocked positions, which may allow the table to be folded.

A still further aspect is a table that may be quickly and easily manufactured. For example, the table may include relatively few components and the components may be quickly and easily produced. Additionally, a rather straightforward design may facilitate manufacturing of the table. The table may also have increased reliability because it may have few moving parts. Advantageously, reducing the number of parts may allow the table to be more quickly assembled, and may increase reliability.

Another aspect is a locking mechanism for a folding table that may include a tabletop and at least one support structure sized and configured to support the tabletop above a surface. The support structure may be movable between a use position and a collapsed position. The locking mechanism may be sized and configured to lock the tabletop in a fixed position. The folding table may include a hinge assembly with a first bracket and a second bracket. The first bracket may include a cam surface and an engagement portion. The second bracket may include an elongated opening. A connector, such as a pin, rivet, crossmember, or the like, may rotatably connecting the first bracket and the second bracket. A locking member may include a first portion and a second portion. A connecting portion may connect the first portion and the second portion. The first portion, the second portion, and the connecting portion part of a unitary, one-piece structure. The first portion of the locking member may be connected to the connector of the hinge assembly. A locking structure may be disposed within the elongated opening in the second bracket of the hinge assembly, and the locking structure may be connected to the second portion of the locking member. The locking structure may be movable between a locked position and an unlocked position, and the locking member may be sized and configured to bias the locking structure into the locked position.

Still another aspect is a folding table that may include a hinge assembly with a first bracket with one or more flanges; a second bracket with one or more flanges; a cam surface may be formed by a portion of the one or more of the flanges of the first bracket; and an engagement surface may be formed by a portion of the one or more flanges of the first bracket. A locking mechanism may include a locking member with an engaging surface, and a user may apply a force to the engaging surface to unlock the locking mechanism. The engaging surface of the locking member may extend outwardly from a first portion of the locking member, and the locking member may rotate about the connector when a force is applied to the engaging surface. A force applied to the engaging surface may rotate the locking member relative to the connector, and the rotation of the locking member relative to the connector may move the locking structure from the locked position to the unlocked position. The locking member may bias the locking structure into the locked position. The connecting portion of the locking member may include an angled portion that is resiliently deformable to allow the locking structure to move between the locked and unlocked positions. The connecting portion of the locking member may have a generally U-shaped configuration that is resiliently deformable to allow the locking structure to move between the locked and unlocked positions. The connecting portion of the locking member may have a generally U-shaped configuration that is resiliently deformable to allow the locking structure to move between the locked and unlocked positions, the connecting portion may bias the locking structure towards the first portion of the locking member, and rotation of the first portion of the locking member may move the locking structure between the locked and unlocked positions. The locking member may be rotatably connected to the connector. The first portion of the locking member may be rotatably connected to the connector, and the second portion of the locking member may be rotatably connected to the locking structure. A hinge assembly may pivotally connect a first section and a second section of a tabletop, the locking structure may engage the engagement surface in the locked position to prevent the hinge assembly from rotating, and the locking structure may disengage from the engagement surface in the unlocked position to allow the hinge assembly to rotate. A release may extend outwardly from the first portion of the locking member, a force applied to the release may rotate the first portion of the locking member and the rotation of the first portion of the locking member may cause the second portion of the locking member to move the locking structure from the locked position to the unlocked position. A release may extend outwardly from the locking member, the locking member may be substantially disposed between one or more flanges of the first bracket and one or more flanges of the second bracket, and the release may extend beyond an outer surface of the one or more flanges of the first bracket and the one or more flanges of the second bracket.

Yet another aspect is a locking mechanism for a fold-in-half table. The fold-in-half table may include a tabletop, a frame, at least one support structure sized and configured to support the tabletop above a surface, and the support structure may be movable between a use position and a collapsed position. The fold-in-half table may include a hinge assembly, and the hinge assembly may include a first bracket connected to a first portion of a tabletop, the first bracket may include an engagement surface and a cam surface, a second bracket may be connected to a second portion of the tabletop, the second bracket may including a slot, and a connector may rotatably connect the first bracket and the second bracket. A locking structure may be disposed within the slot, and the locking structure may be movable between a locked position where the locking structure engages the engagement surface and an unlocked position where the locking structure is spaced apart from the engagement surface. A locking member may include a first portion rotatably connected to the connector, and a second portion connected to the locking structure. Rotation of the first portion of the locking member about the connector may cause the second portion of the locking member to move the locking structure between the locked and unlocked positions. The locking member may bias the locking structure into the locked position. A release may extend from the first portion of the locking member, and the release may be sized and configured to rotate the first portion of the locking member about the connector when a user applies a force to the release. The locking member may be biased to move the locking structure from the unlocked position to the locked position, and when the fold-in-half tabletop is disposed in the unfolded position, the locking member may automatically lock the locking mechanism in the locked position. The locking member may include a connecting portion connecting the first portion and the second portion of the locking member, the connecting portion may be resiliently deformable to allow the locking structure to move between the locked and unlocked positions, and the locking member may bias the locking structure into the locked position.

Still yet another aspect is a table that may include a tabletop with a first portion and a second portion, and a hinge assembly may pivotally connect the first portion and the second portion of the tabletop. The hinge assembly may include a first bracket with a cam surface and an engagement portion, a second bracket with an elongated opening, and a connector that rotatably connects the first bracket and the second bracket. One or more support structures may be connected to the tabletop, and the support structures sized and configured to support the tabletop above a surface. A locking mechanism may be sized and configured to lock the tabletop in a fixed position. The locking mechanism may include a locking member with a first portion, a second portion, and a connecting portion connecting the first portion and the second portion. The first portion, the second portion, and the connecting portion may form part of a unitary, one-piece structure. The first portion of the locking member may be rotatably connected to the connector of the hinge assembly. A locking structure may be disposed within the elongated opening in the second bracket of the hinge assembly, the locking structure may be connected to the second portion of the locking member, the locking structure may be movable between a locked position and an unlocked position, and the locking member sized and configured to bias the locking structure into the locked position.

These and other aspects, features and advantages of the present invention will become more fully apparent from the following brief description of the drawings, the drawings, the detailed description of preferred embodiments and appended claims.

BRIEF DESCRIPTION OF THE DRAWINGS

The appended drawings contain figures of preferred embodiments to further illustrate and clarify the above and other aspects, advantages, and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF EXEMPLARY EMBODIMENTS

Figure 1:
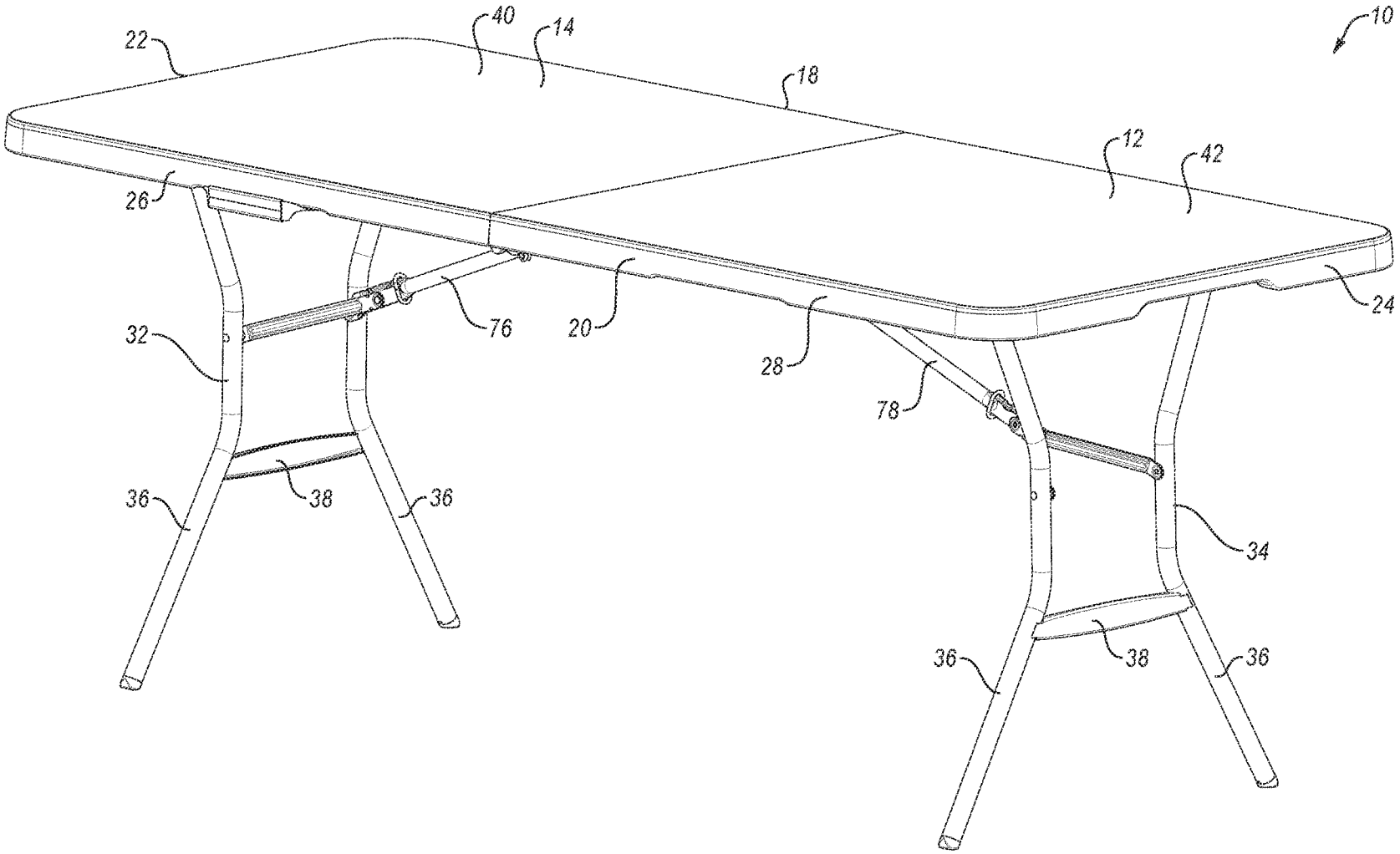
FIG. 1 is an upper perspective view of an exemplary table, illustrating exemplary support structures in extended or use positions.

The present invention is generally directed towards locking mechanisms for furniture, such as locking mechanisms for folding or fold-in-half tables. The principles of the present invention, however, are not limited to locking mechanisms for furniture or locking mechanisms for folding tables. It will be understood that, in light of the present disclosure, the locking mechanism may be successfully used in connection with other types of structures, devices, and the like.

Additionally, to assist in the description of the locking mechanism and folding tables, words such as top, bottom, front, rear, right and left may be used to describe the accompanying figures. It will be appreciated the locking mechanism and folding tables may be disposed in other positions and/or arrangements, used in a variety of situations, and may perform different functions. In addition, the drawings may be to scale, and the drawings may illustrate various shapes, sizes, configurations, arrangements, aspects, and features of the locking mechanism, folding tables, and the like. It will be appreciated that the locking mechanisms, folding tables, and the various components may have other suitable shapes, sizes, configurations, and/or arrangements depending, for example, upon the intended use of the table. Further, the locking mechanism and the folding table may include any suitable number or combination of components, aspects, features, and the like. While the locking mechanism and folding table may include various components, aspects, features, and the like, the various components, aspects, features, and the like may not be required. A detailed description of exemplary embodiments of the locking mechanism and folding table now follows.

As shown in the accompanying figures, an exemplary table 10 may include a tabletop 12 with an upper portion or surface 14, a lower portion or surface 16, a first side 18, a second side 20, a first end 22 and a second end 24. The upper portion 14 of the tabletop 12 may have a generally planar configuration, and the upper portion of the tabletop may create a working surface. The upper portion 14 of the tabletop 12 may be textured, and the tabletop may include an outer perimeter or edge 26. The tabletop 12 may include a lip 28, and the lip may be disposed about the periphery or perimeter 26 of the tabletop. As shown in the accompanying figures, the lip 28 may have different heights, and the lip may extend about the entire perimeter 26 of the tabletop 12. The lip 28 may have different heights, for example, to allow a handle to be connected to the table 10. The lip 28 may also be sized and configured to facilitate folding and/or unfolding of the table 10. In addition, the lip 28 may be sized and configured to create a table 10 with pleasing aesthetics, and the lip may be sized and configured to cover, conceal, and/or protect portions of the table 10, such as a frame and/or support structures. Further, the tabletop 12 may include other features and aspects, such as grooves, recesses, and receiving portions, and the edges of the tabletop 12 may be beveled, sloped, and/or rounded.

The lip 28 may extend downwardly relative to the upper portion 14 and/or the lower portion 16 of the tabletop 12. The lip 28 may also be disposed near or at least proximate the perimeter 26 of the tabletop 12. For example, the lip 28 may extend downwardly relative to the upper portion 14 and the lower portion 16 of the tabletop 12, and the lip 28 may be aligned with and/or form at least a part of the perimeter 26 of the tabletop 12. It will be appreciated that all or a portion the lip 28 may be spaced inwardly from the perimeter 26 of the tabletop 12, and the lip 28 may have other suitable shapes, sizes, configurations, and/or arrangements. While the exemplary tables 10 and the exemplary tabletops 12 shown in the accompanying figures include the lip 28, it will be appreciated that the lip 28, and other features and aspects of the table 10, may not be required or necessary. It will also be appreciated that the table 10 and its various components may have other shapes, sizes, configurations, and/or arrangements depending, for example, upon the intended use of the table 10. It will further be appreciated that the table 10 can include any suitable number of features, aspects, and the like, such as disclosed in U.S. Pat. Nos. 6,530,331; 7,111,563; 7,475,643; 7,814,844; and 7,975,625; each of which is incorporated by reference in its entirety.

As shown in the accompanying figures, the tabletop 12 may have a generally rectangular configuration with rounded corners. The tabletop 12 may have a relatively large size and the table 10 may be configured for use as a banquet or utility table. For example, the tabletop 12 may have a length between about four feet and about ten feet, such as a length such of about five feet, about six feet, about eight feet, and the like. The tabletop 12 may have a width between about two feet and about three feet, such as about two and one-half feet. It will be appreciated that the tabletop 12 could be larger or smaller, and it will be appreciated that the tabletop 12 could have other suitable shapes and configurations such as square, circular, oval and the like; and the sides, corners, edges and other portions of the tabletop 12 could have various shapes, sizes, configurations and arrangements depending, for example, upon the intended use of the table 10. Further, the table 10 could be any suitable type of table such as a folding table, non-folding table, card table, personal table, round table, conference table, and the like. The table 10 could also be used for various purposes such as a desk, support structure, display, etc.

The tabletop 12 may be constructed from lightweight materials such as plastic. In particular, the tabletop 12 may be constructed from materials such as high-density polyethylene, but other suitable plastics and types of materials may also be used. The tabletop 12 may be formed using a blow-molding process, and blow-molding may allow a relatively strong, lightweight, rigid, and/or sturdy tabletop 12 to be created. The tabletop 12 may be rather quickly and inexpensively manufactured from blow-molded plastic. The blow-molded plastic tabletop 12 may be relatively durable, weather resistant, temperature insensitive, corrosion resistant, rust resistant, and may not deteriorate over time. One of ordinary skill in the art will appreciate the tabletop 12 does not have to be constructed from blow-molded plastic and other suitable materials and/or processes can be used to construct the tabletop 12. For example, the tabletop 12 may be constructed from other types of plastics, polymers, synthetic materials, natural materials, and the like. The tabletop 12 may also be formed from processes such as injection molding, rotational molding, rotary molding, etc. In addition, the tabletop 12 may be constructed from other materials with sufficient strength and desirable characteristics such as wood, metal, alloys, composites, fiberglass, ceramics, and the like.

Figure 2:
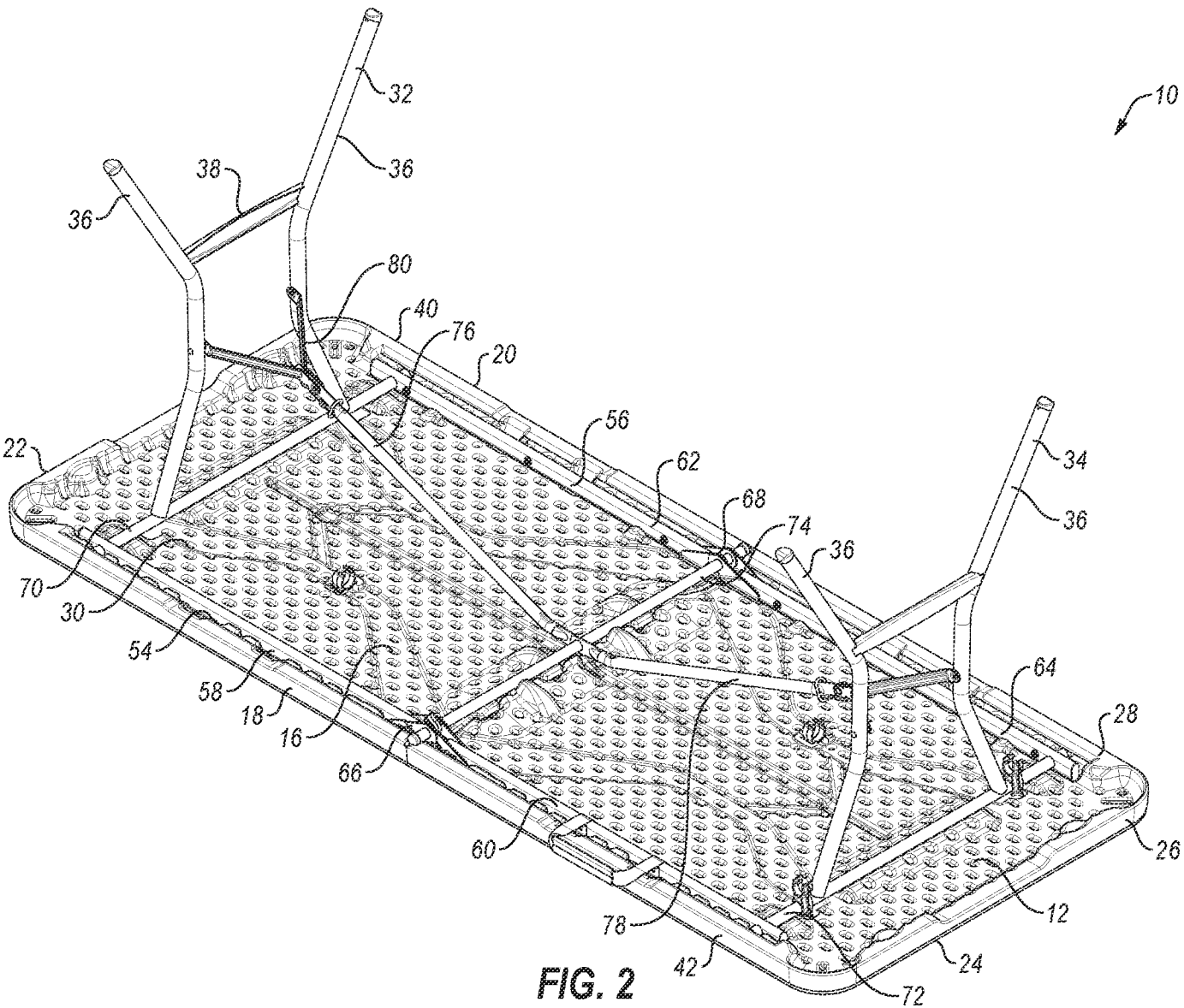
FIG. 2 is a lower perspective view of the exemplary table, illustrating exemplary support structures in extended or use positions.
Figure 3:
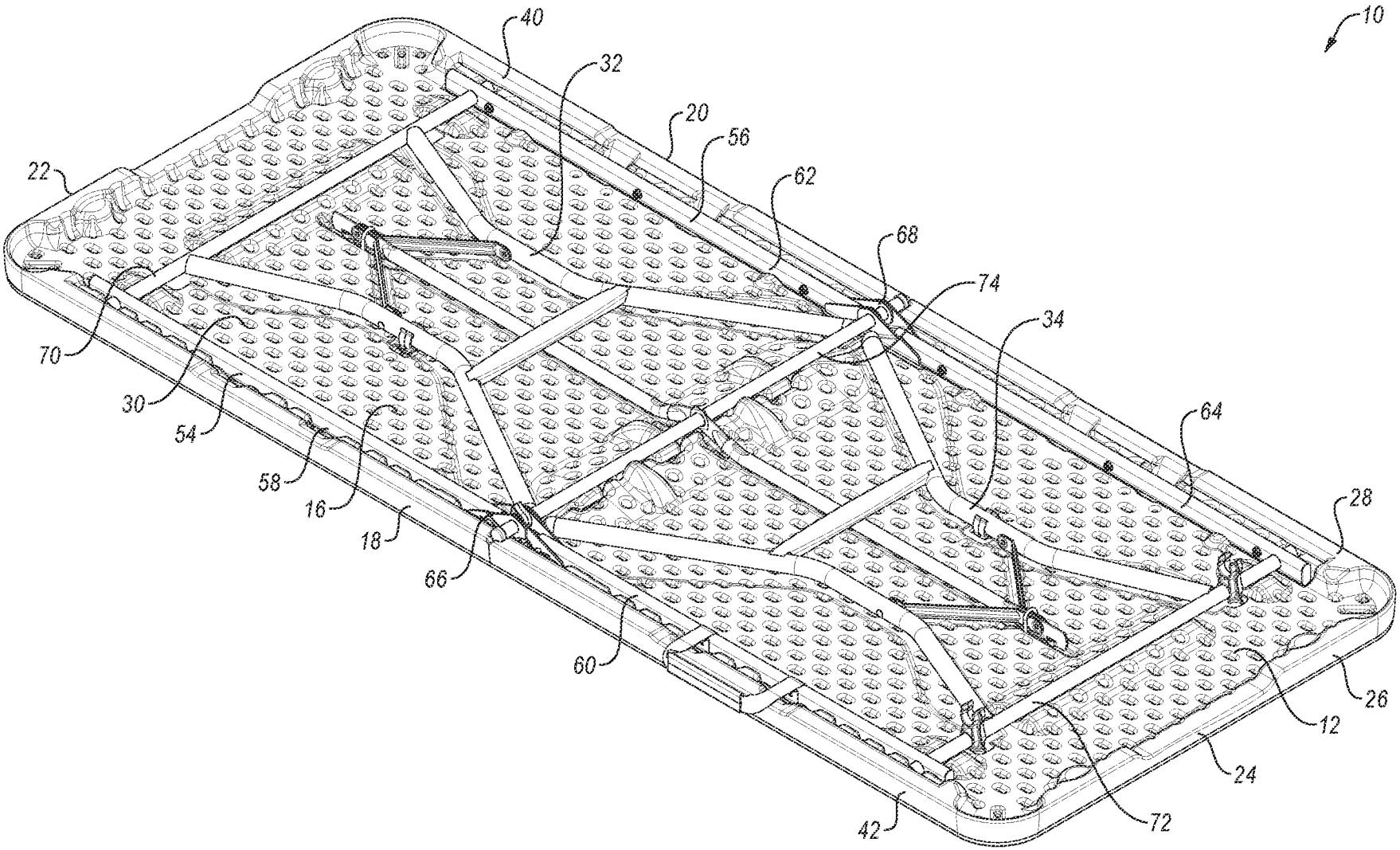
FIG. 3 is another lower perspective view of the exemplary table, illustrating the exemplary support structures in collapsed or storage positions.

The tabletop 12 may include spaced apart outer walls, such as the upper surface 14 and the lower surface 16, which may help create a strong and rigid tabletop 12. For instance, the upper and lower surfaces 14, 16 of the tabletop 12 may be separated by a distance, and the distance may be a generally constant distance. The upper and lower surfaces 14, 16 of the tabletop 12 may be generally aligned and/or disposed in generally parallel planes. As shown in FIGS. 2 and 3, the tabletop 12 may include one or more depressions 30, which may also be known as tack-offs. The depressions 30 may be disposed in the lower surface 16 of the tabletop 12, and the depressions 30 may be sized and configured to increase the strength, structural integrity, and/or rigidity of the tabletop 12. The depressions 30 may also be used to create a tabletop 12 with more uniform properties and characteristics, and the depressions may cover a majority, substantially all, or the entire lower surface 16 of the tabletop 12. Advantageously, the depressions 30 may be integrally formed with the tabletop 12 as part of a unitary, one-piece construction, and the depressions 30 may be formed in any desired portions of the tabletop 12. The depressions 30, and other portions of the table 10, may have other shapes, sizes, configurations, and/or arrangements, and may include other features, such as disclosed in U.S. Pat. Nos. 7,069,865; 7,114,453; 7,143,702; and 7,210,277; and U.S. Patent Publication No. 2006-0230989; each of which is incorporated by reference in its entirety.

The table 10 may include one or more support structures sized and configured to support the tabletop 12 above a surface. For example, the table 10 may include a first support structure 32 and a second support structure 34, and each support structure may include one or more legs or supports 36. The legs 36 may be connected by one or more connecting members 38. The support structures 32, 34 may be movable between an extended or use position in which the legs 36 extend outwardly from the tabletop 12, and a collapsed or storage position in which the legs 36 are disposed at least proximate the tabletop 12. After reviewing this disclosure, one of ordinary skill in the art will be appreciated that the table 10 may include any suitable number, size, shape, configuration, and/or arrangement of the support structures 32, 34; the legs 36; and/or the connecting members 38 depending, for example, upon the intended use of the table 10.

Figure 4:
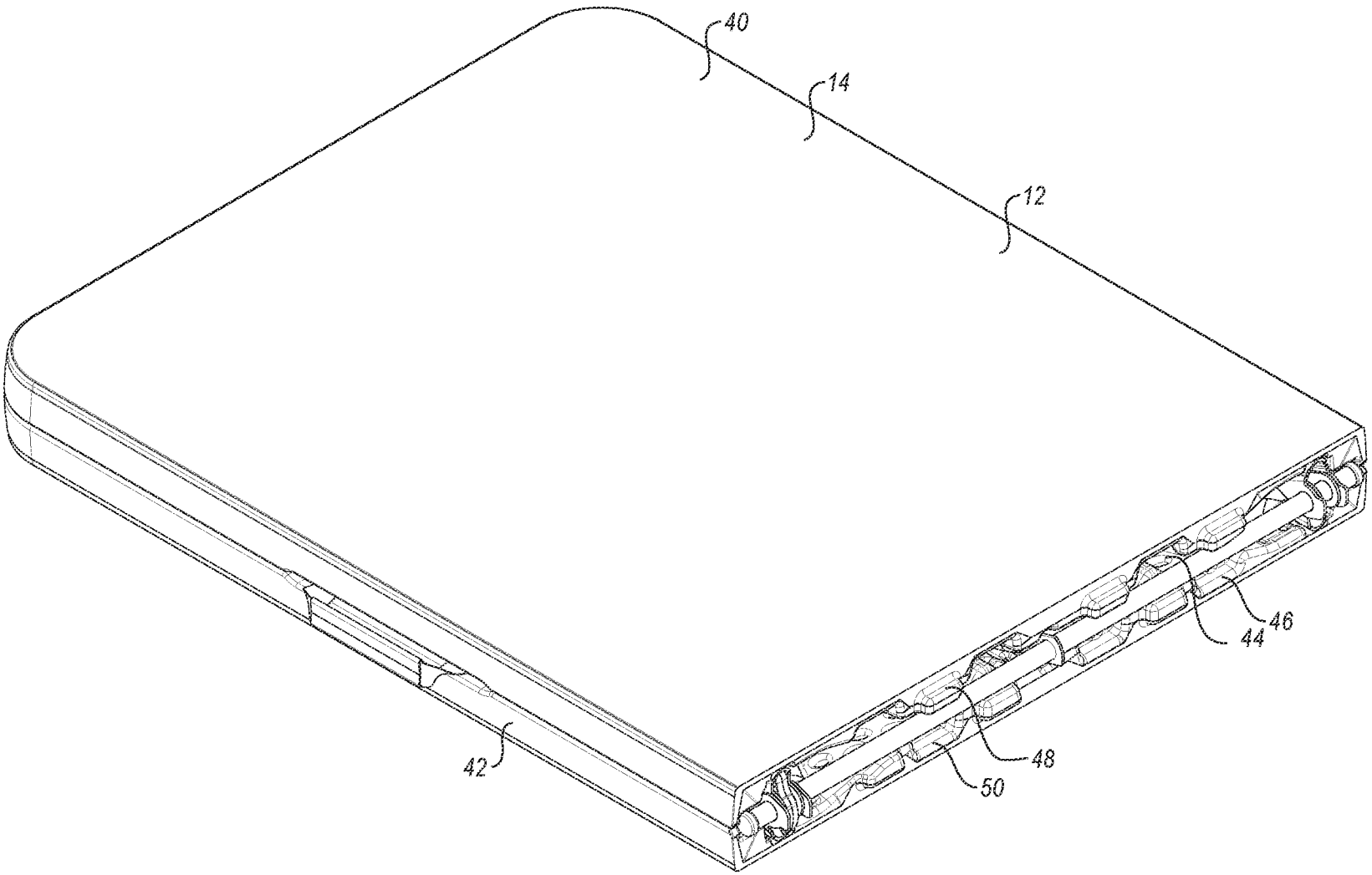
FIG. 4 is a perspective view of an exemplary table, illustrating the table in a folded or storage position.

The table 10 may be a folding or fold-in-half table, and the tabletop 12 may include a first section 40 and a second section 42. The first and second sections 40, 42 of the tabletop 12 may be movable between a use or unfolded configuration, such as shown in FIGS. 1-3, and a collapsed or folded configuration such as shown in FIG. 4. In addition, the first and second support structures 32, 34 may be movable between use and collapsed configurations. For example, as shown in FIG. 2, the table 10 may be in the unfolded or use configuration, and the first support structure 32 may extend outwardly relative to the first section 40 of the tabletop 12. In addition, the second support structure 34 may extend outwardly relative to the second section 42 of the tabletop 12. As shown in FIG. 3, the first support structure 32 may be disposed generally parallel to and/or at least proximate the lower portion 16 the first section 40 of the tabletop 12 when the first support structure is in the collapsed or storage position. Similarly, the second support structure 34 may be disposed generally parallel to and/or at least proximate the lower portion 16 of the second section 42 of the tabletop 12 when the second support structure is in the collapsed or storage position. In addition, the first and second sections 40, 42 of the tabletop 12 may be movable between folded and unfolded positions. The first and second sections 40, 42 may be generally aligned and/or disposed in generally the same plane when the tabletop 12 is in the unfolded position, and the first and second sections 40, 42 of the tabletop 12 may be disposed generally adjacent and/or parallel to each other when the tabletop 12 is in the folded position.

As shown in the accompanying figures, the first and second sections 40, 42 of the tabletop 12 may have a generally rectangular configuration. The first and second sections 40, 42 of the tabletop 12 may also have a generally symmetrical and/or mirror-image configuration. In addition, the first section 40 of the tabletop 12 may include an inner surface 44 that is sized and configured to contact and/or engage an inner surface 46 of the second section 42 of the tabletop when the table 10 is in the unfolded position. The inner surfaces 44, 46 may be spaced apart when the tabletop 12 is in the folded position. As shown in FIG. 4, the inner surfaces 44, 46 of the tabletop 12 may include one or more interlocking, overlapping and/or connecting portions, such as an engaging portion 48 and a receiving potion 50, which may provide additional strength, stability and/or rigidity to at least the center portion of the tabletop. The tabletop 12 may also have other shapes, sizes, configurations, and arrangements, such as shown in U.S. Pat. No. 7,096,799, which is incorporated by reference in its entirety.

As seen in the accompanying figures, the table 10 may include a frame 52 and the frame may be connected to the tabletop 12. The exemplary frame 52 may include one or more elongated members, such as rails. For example, a first siderail 54 may be disposed at least proximate the first side 18 of the tabletop 12, and a second siderail 56 may be disposed at least proximate the second side 20 of the tabletop 12. The first siderail 54 may include a first portion 58 connected to the first section 40 of the tabletop 12 and a second portion 60 connected to the second section 42 of the tabletop. The second siderail 56 may include a first portion 62 connected to the first section 40 of the tabletop 12 and a second portion 64 connected to the second section 42 of the tabletop. The first and second siderails 54, 56 may be positioned at least proximate the lip 28 along the first and second sides 18, 20 of the tabletop 12, and the first and second siderails 54, 56 may extend almost the entire length of the first and second portions 40, 42 of the tabletop 12. It will be appreciated that the frame 52 may have other shapes, sizes, configurations, and/or arrangements depending, for example, upon the intended use of the table 10. For example, the frame 52 could include one or more features or aspects such as disclosed in U.S. Pat. No. 8,555,789, which is incorporated by reference in its entirety.

The first and second siderails 54, 56 of the frame 52 may be pivotally connected. For example, a first hinge assembly 66 may be connected to the first and second portions 58, 60 of the first side rail 54, and a second hinge assembly 68 may be connected to the first and second portions 62, 64 of the second side rail 56. The first and second hinge assemblies 66, 68 may allow the table 10 to be moved between the folded and unfolded positions.

Figure 5:
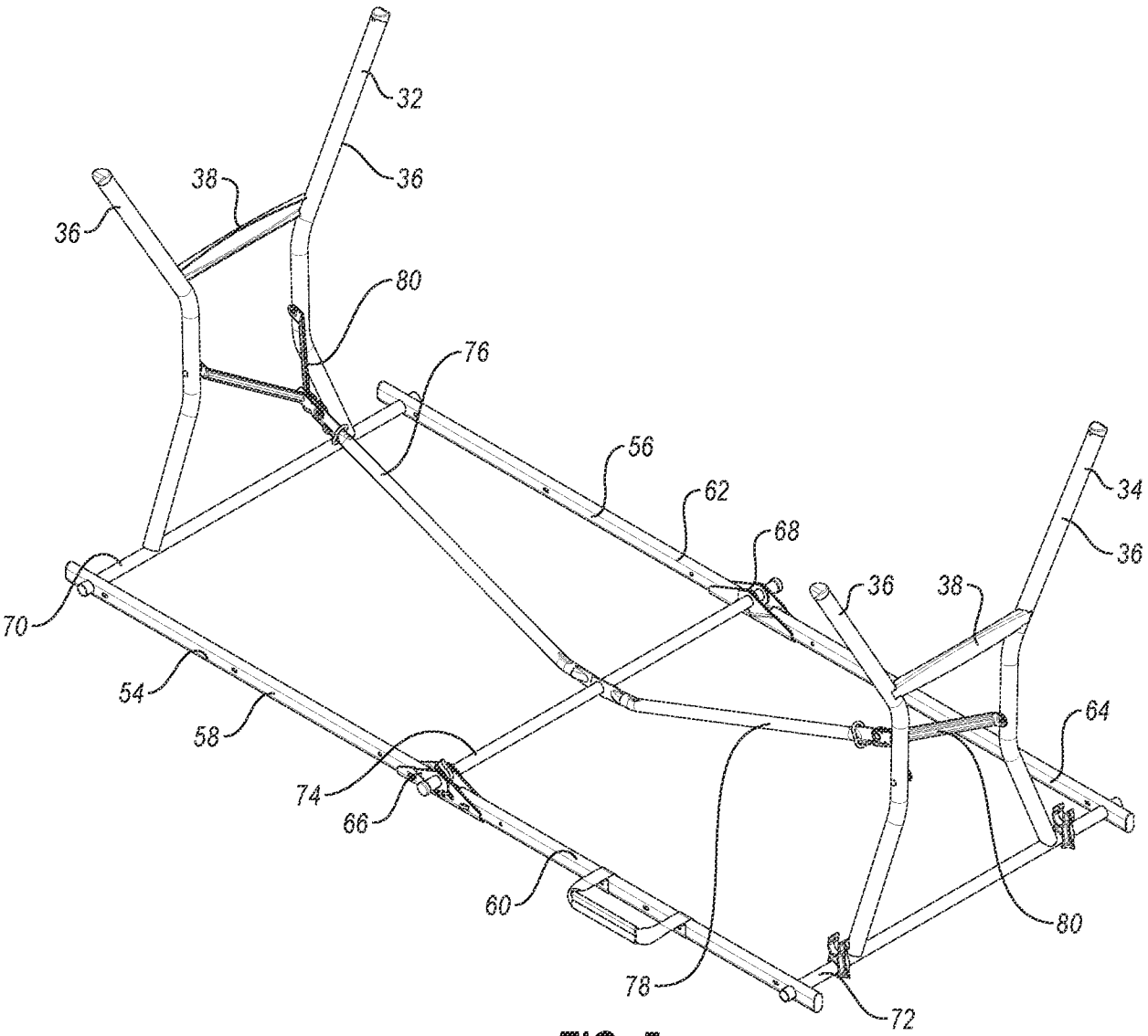
FIG. 5 is a perspective view of an exemplary frame for a table, illustrating exemplary support structures in extended or use positions.
Figure 6A:
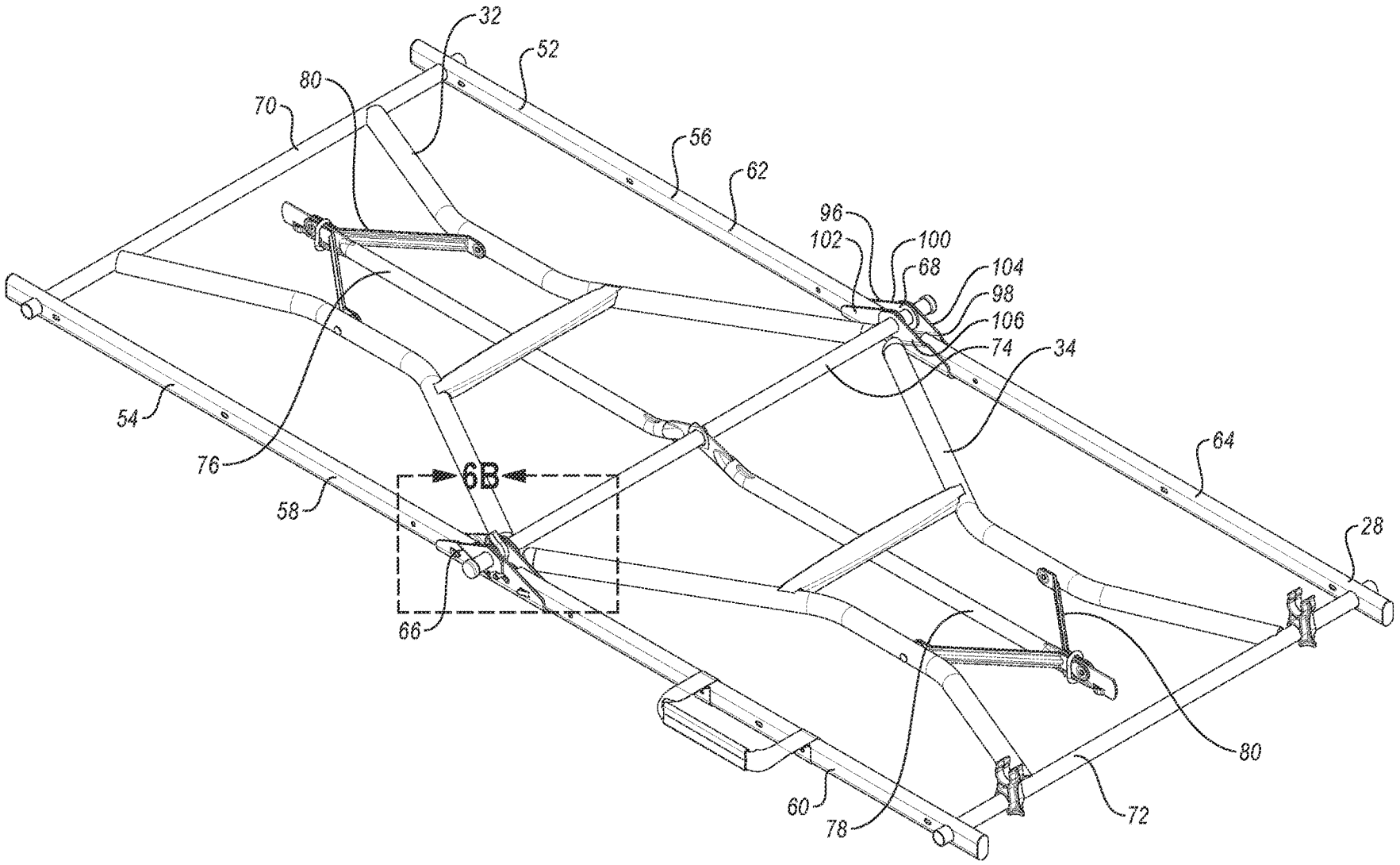
FIG. 6A is perspective view of an exemplary frame and exemplary locking mechanism, illustrating exemplary support structures in collapsed or storage positions.

The first support structure 32 may be connected to the frame 52. For example, a first cross member 70 may connect the first support structure 32 and the frame 52, and a second cross member 72 may connect the second support structure 34 and the frame. 62. As seen in FIGS. 5 and 6A, the ends of the first and second cross members 70, 72 may be disposed in openings in the siderails 54, 56 of the frame 52, which may allow the cross members 70, 72 to rotate relative to the frame 52. The cross member 70, 72 may be part of the support structures 32, 34 and/or the frame 52, if desired. The support structures 32, 34 and/or the cross members 70, 72 may have other suitable shapes, sizes, configurations, and/or arrangements, such as shown in U.S. Pat. No. 7,100,518, which is incorporated by reference in its entirety.

The table 10 may include any suitable number of cross members, such as the cross members 70, 72, and the cross members may be disposed in various positions of the table 10. For example, the cross members 70, 72 may be disposed towards the first and second ends 22, 24, of the tabletop 12, and one or more cross members may be disposed between the cross members 70, 72. For instance, a cross member 74 may be disposed between the cross members 70, 72, and the cross member 74 may be disposed at least proximate a center portion of the tabletop 12. The cross member 74 may be aligned with an axis of rotation as the table 10 moves between the folded and unfolded positions. The cross member 74 may be connected to the hinge assemblies 66, 68. For example, the cross member 74 may be rotatably coupled to one or both of the hinge assemblies 66, 68. The cross member 74 could also be connected to other suitable portions of the table 10. The table 10 could include one or more cross members, and other features and aspects, such as disclosed in U.S. Pat. Nos. 8,397,653, 8,573,139, and 9,763,513, each of which is incorporated by reference in its entirety. The table 10, however, may not include the cross members 70, 72, and/or 74.

As seen in FIGS. 5 and 6A, a first cross brace 76 may connect the cross member 74 and the first support structure 32, and a second cross brace 78 may connect the cross member 74 and the second support structure 34. The first and second cross braces 76, 78 may include a pair of arms 80, and the arms may be pivotally connected to the legs 36. The cross braces 76, 78 may be rotatably or non-rotatably connected to the cross member 74. After reviewing this disclosure, one of ordinary skill in the art will be appreciated that the cross braces 76, 78 may have other suitable shapes, sizes, configurations, and/or arrangements. For example, the first cross brace 76 may connect the support structure 32 and the frame 52, and the second cross brace 78 may connect the support structure 34 and the frame 52. In an exemplary embodiment, the first cross brace 76 may connect the first support structure 32 and the first side rail 54 and/or the second side rail 56. For instance, the first cross brace 76 may connect the first portion 58 of the first side rail 58 and/or the first portion 62 of the second side rail 56 and the first support structure 32. The second cross brace 78 may connect the second support structure 34 and the first side rail 54 and/or the second side rail 54. For example, the second cross brace 78 may connect the second portion 60 of the first side rail 54 and/or the second portion 64 of the second side rail 56 and the second support structure 34. After reviewing this disclosure, one of ordinary skill in the art will appreciated the cross members 70, 72, 74, and the cross braces 76, 78 may have other suitable shapes, sizes, configurations, and/or arrangements depending, for example, upon the intended use of the table 10.

Figure 6B:
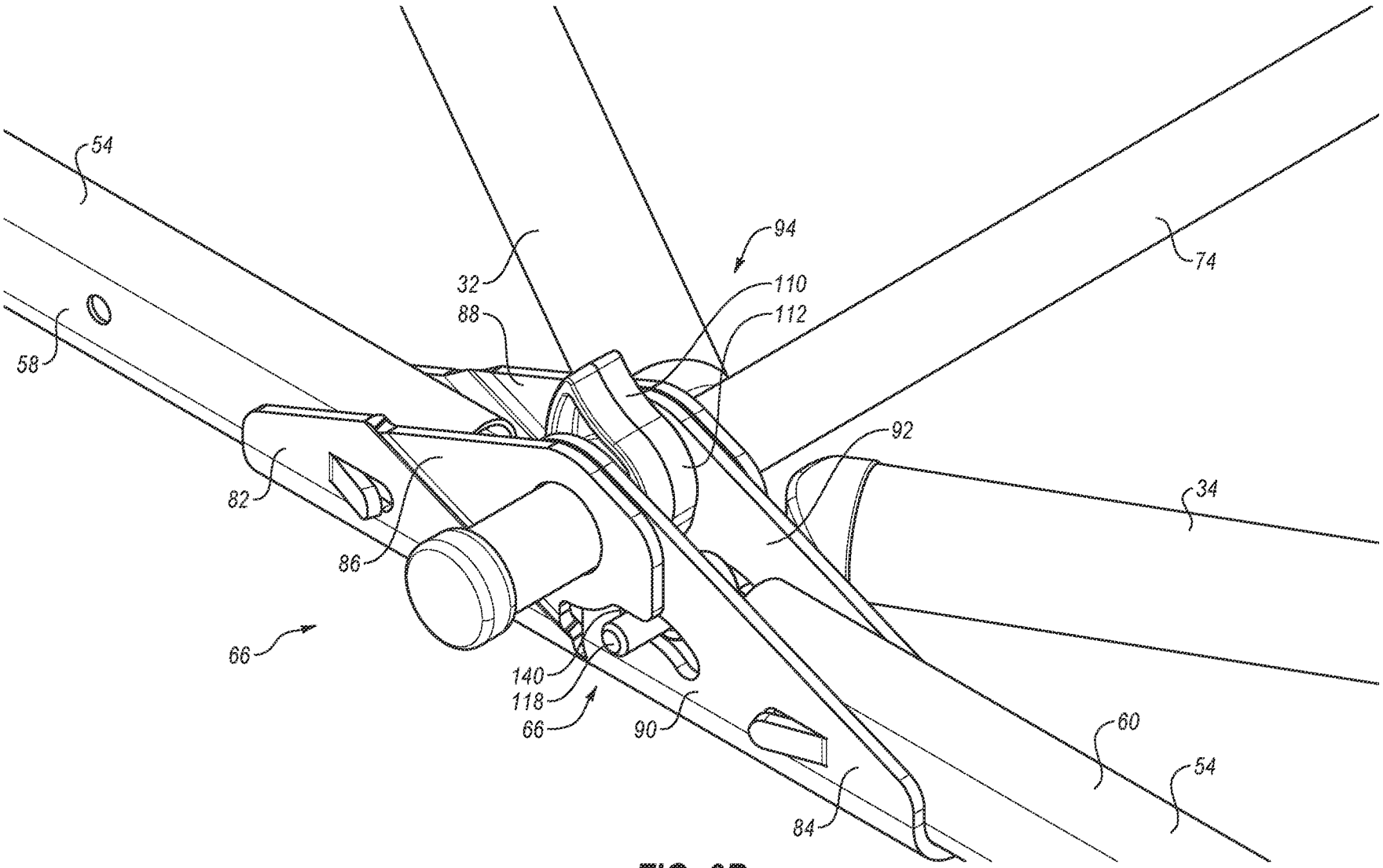
FIG. 6B is an enlarged perspective view of a portion of the exemplary frame and exemplary locking mechanism shown in FIG. 6A, illustrating an exemplary locking mechanism in a locked position.
Figure 6C:
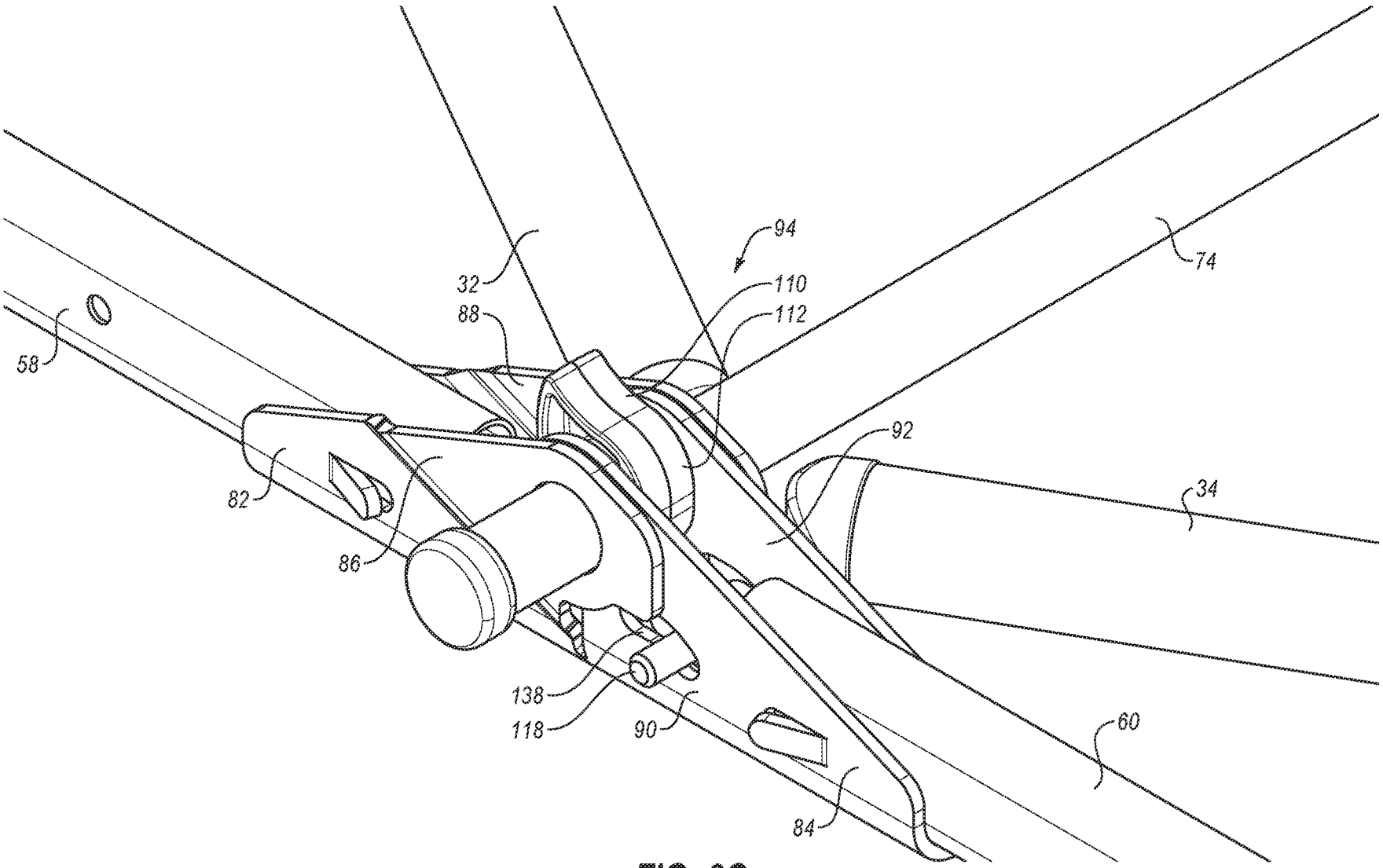
FIG. 6C is another perspective view of the portion of the exemplary frame and exemplary locking mechanism shown in FIG. 6B, illustrating the exemplary locking mechanism in an unlocked position.
Figure 7A:
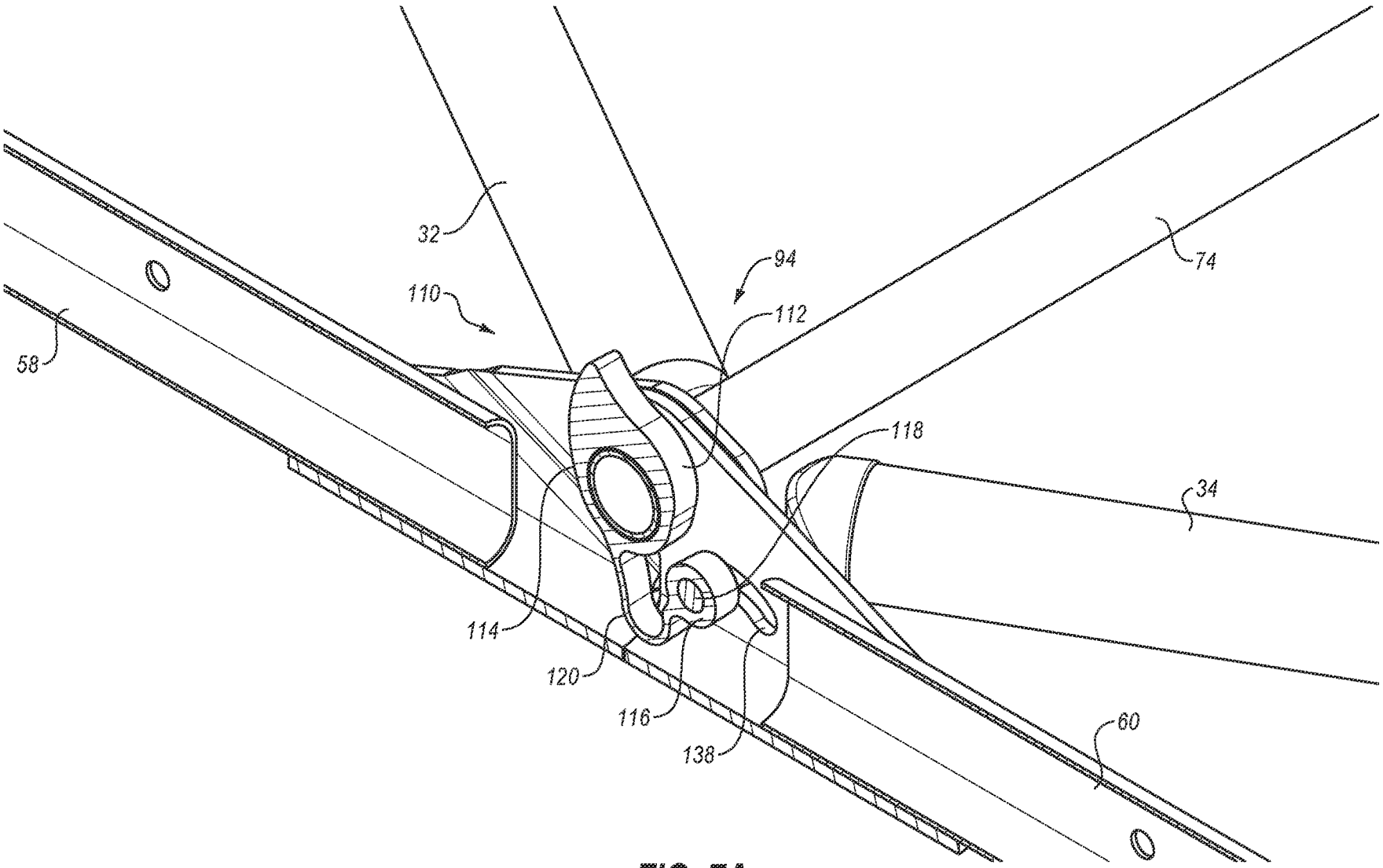
FIG. 7A is a partial cut-away perspective view of a portion of an exemplary frame and an exemplary locking mechanism, illustrating the locking mechanism in an exemplary locked position.
Figure 7B:
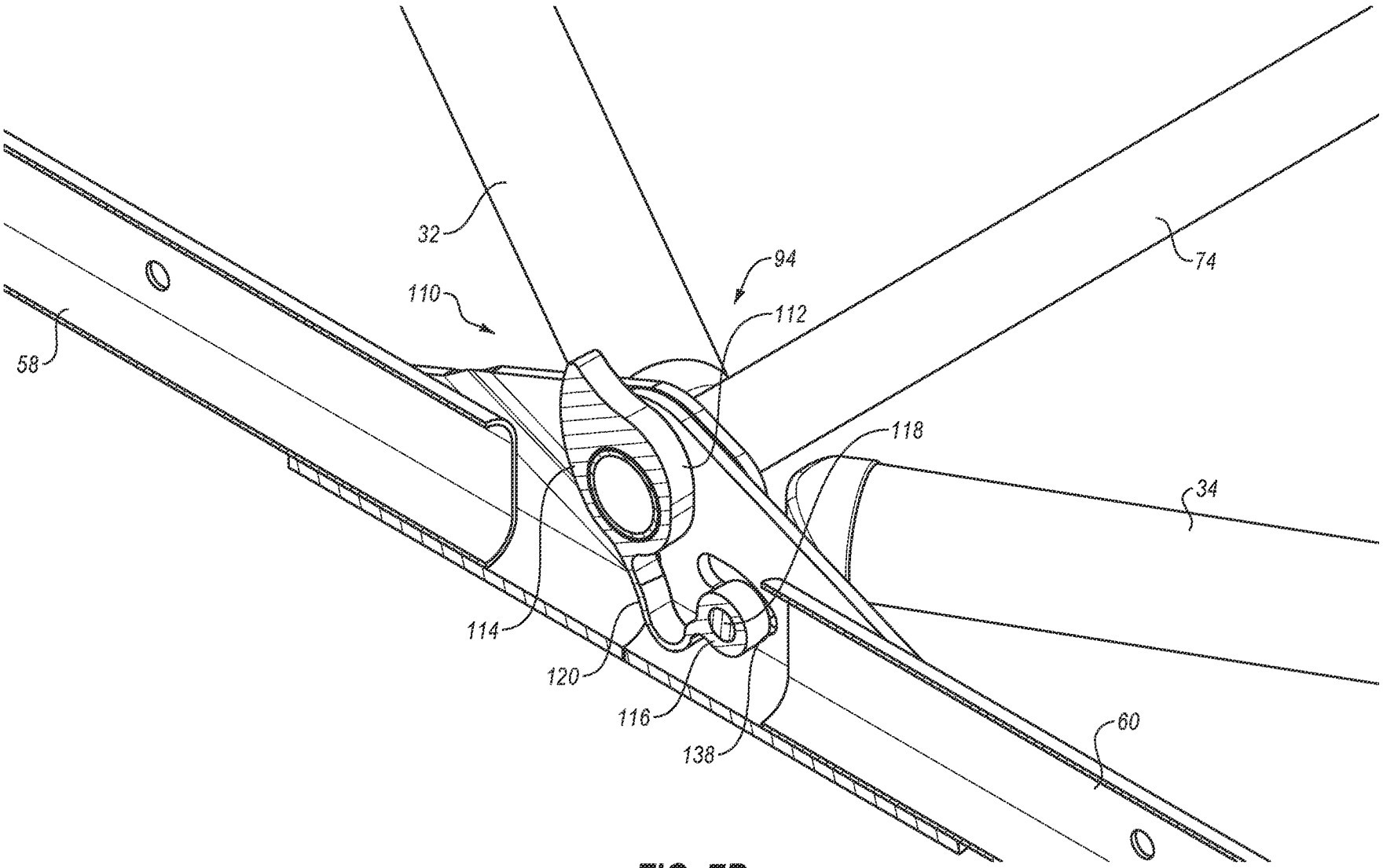
FIG. 7B is another partial cut-away perspective view of a portion of the exemplary frame and exemplary locking mechanism shown in FIG. 7A, illustrating the locking mechanism in an exemplary unlocked position.
Figure 8:
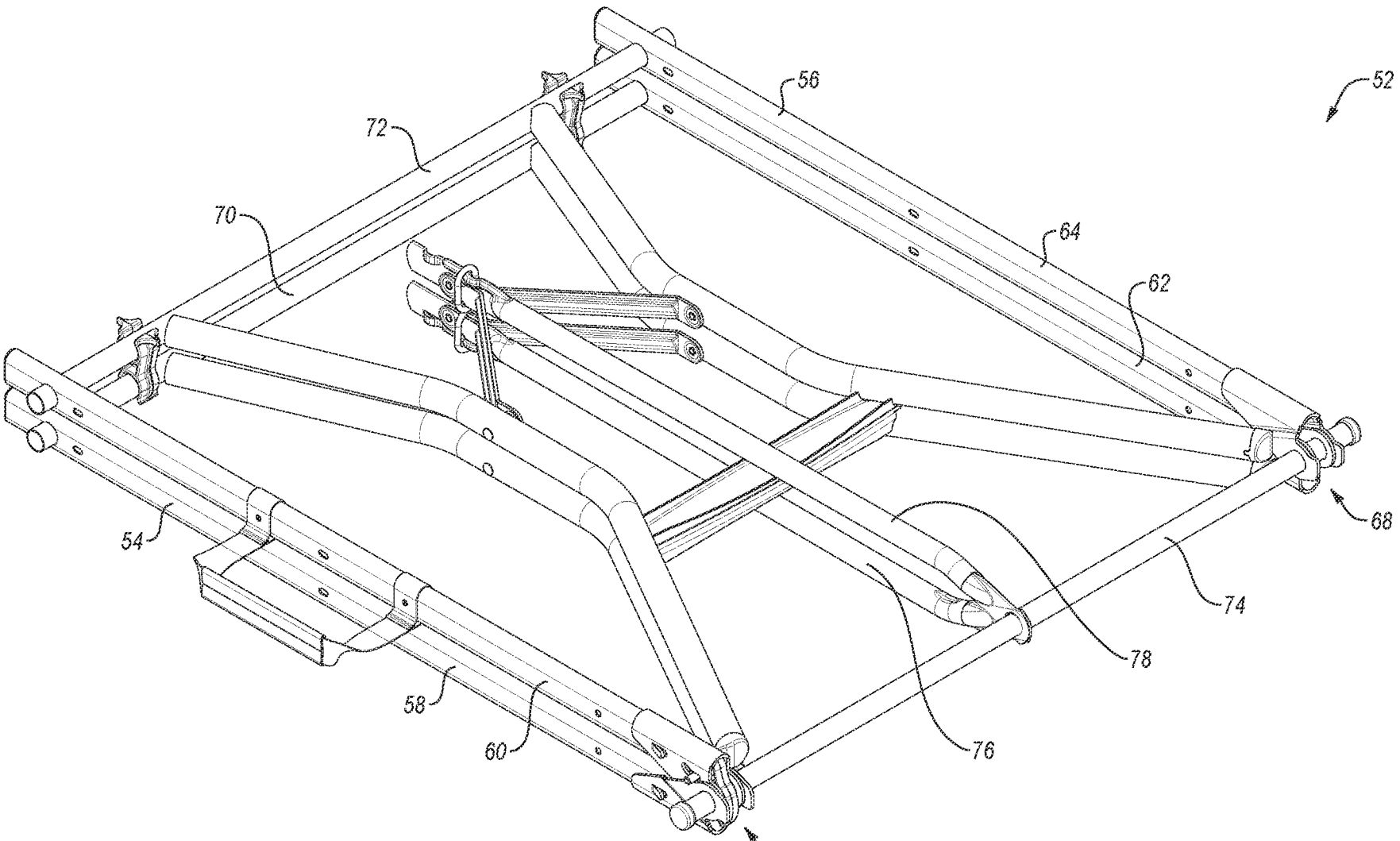
FIG. 8 is a perspective view of an exemplary frame, illustrating the frame in an exemplary collapsed or folded position.

In an exemplary embodiment, the cross member 74 may be connected to the hinge assemblies 66, 68, such as shown in FIGS. 6A-6C. The cross member 74, however, does not have to be connected to the hinge assemblies, and the table 10 may not include the cross member 74.

As shown in FIGS. 6B and 6C, for example, the first hinge assembly 66 may include a first bracket 82, and the first bracket 82 may be connected to the first portion 58 of the first siderail 54. The first hinge assembly 66 may also include a second bracket 84, and the second bracket 84 may be connected to the second portion 60 of the first siderail 54. The first bracket 82 may include one or more flanges, such as a first pair of flanges 86, 88, and the second bracket 84 may include one or more flanges, such as a second pair of flanges 90, 92. The first and second brackets 82, 84 of the first hinge assembly 66 may be pivotally connected. For example, the first and second brackets 82, 84 of the first hinge assembly 66 may be pivotally connected by one or more connectors 94. The connector 94 may be a pin, rivet, connecting member, etc. In an exemplary embodiment, the connector 94 may be the cross member 74. For instance, an end of the cross member 74 may be inserted through one or more apertures in the flanges 86, 88, 90, and/or 92. After reviewing this disclosure, one of ordinary skill in the art will appreciate that the connector 94 may have different shapes, sizes, configurations, and/or arrangements depending, for example, upon the type of table 10.

The second hinge assembly 68 may have a size, shape, configuration, and/or arrangement that is similar the first hinge assembly 66. For example, the second hinge assembly may include a first bracket 96 connected to the first portion 62 of the second siderail 56. The second hinge assembly 68 may also include a second bracket 98 connected to the second portion 64 of the second siderail 56. The first bracket 96 may include one or more flanges, such as a first pair of flanges 100, 102, and the second bracket 98 may include one or more flanges, such as a second pair of flanges 104, 106. The first and second brackets 96, 98 of the second hinge assembly 68 may be pivotally connected. For example, the first and second brackets 96, 98 of the second hinge assembly 68 may be pivotally connected by one or more connectors 108. The connector 108 may be a pin, rivet, connecting member, etc. In an exemplary embodiment, the connector 108 may be the cross member 74. For instance, an end of the cross member 74 may be inserted through one or more apertures in the flanges 100, 102, 104, and/or 106. After reviewing this disclosure, one of ordinary skill in the art will appreciate that the hinges assemblies 66, 68 may have a similar or different shapes, sizes, configurations, and/or arrangements. In addition, the table 10 may include any suitable number of hinge assemblies and the hinge assemblies may be disposed in various locations and positions depending, for example, upon the size of the table 10.

A locking mechanism 110 may be used to lock the tabletop 12 in a fixed position, such as the extended or use position. The locking mechanism 110 may also be used to lock the tabletop 12 in other positions, such as an unlocked position. The locking mechanism 110 may be biased into one or more desired positions or configurations. For example, the locking mechanism 110 may be biased to lock the tabletop 12 in a locked position when the tabletop 12 is disposed in the extended or use position. If desired, the locking mechanism 110 may be sized and configured to automatically lock when the tabletop 12 is in a desired position, such as the extended or use position. A force or other input may be required to unlock the locking mechanism 110. For instance, when the tabletop 12 is in the extended or use position and the locking member 110 is disposed in the locked position, a force or input may be required to unlock the locking mechanism 110. When the locking mechanism 110 is unlocked, the tabletop 12 may be moved between the use and collapsed positions. After reviewing this disclosure, one of ordinary skill in the art will appreciate that the locking mechanism 110 may be sized, shaped, configured, and/or arranged to lock the tabletop 12 into any desired positions and the locking mechanism 110 may allow the tabletop 12 to be freely moved between the use and collapsed positions when the locking member 110 is unlocked.

The locking mechanism 110 may be disposed at least proximate one of the hinge assemblies, such as the first hinge assembly 66. For example, the locking mechanism 110 may be at least partially disposed between the first bracket 82 and/or the second bracket 84 of the first hinge assembly 66. After reviewing this disclosure, one of ordinary skill in the art will appreciate that the table 10 may include more than one locking mechanism 110, such as a first locking mechanism 110 with the first hinge assembly 66 and a second locking mechanism 110 with the second hinge assembly 68. One of ordinary skill in the art will also appreciate that the locking mechanism 110 may be connected to any desired portions of the table 10.

As seen in FIGS. 7A, 7B, 9A, and 9B, the locking mechanism 110 may include a locking member 112, and the locking member may include a first portion 114 and a second portion 116. The first portion 114 of the locking member 112 may be connected to a first portion of the table 10, such as the connector 94. The second portion 116 of the locking member 112 may be connected to a locking structure 118, such as a locking pin. The locking structure 118 may be movable between a locked position and an unlocked position. When the locking structure 118 is in the locked position, the tabletop 12 may be disposed in a fixed position. When the locking structure 118 is in the unlocked position, the tabletop 12 may be movable between the use and collapsed positions.

The locking member 112 may include a connecting member 120, and the connecting member 120 may connect the first and second portions 114, 116 of the locking member 112. The first portion 114, the second portion 116, and the connecting member 120 may be part of a unitary, one-piece structure or construction. Advantageously, the unitary, one-piece structure of the locking member 112 may facilitate assembly of the locking mechanism 110 and/or table 10. The unitary, one-piece structure of the locking member 112 may also reduce the number of parts, simplify fabrication, increase production efficiency, streamline manufacturing, and the like.

In an exemplary embodiment, the connecting member 120 may be sized and configured to bias locking member 112 into one or more desired positions or configurations. For example, the locking member 112 may bias the second portion 116 of the locking member 112 into a desired position. For instance, the first portion 114 of the locking member 112 may be connected in a fixed portion of the table 10, such as the connector 94, and the second portion 116 of locking member may be movable relative to the first portion 114 of the locking member 112. In an exemplary embodiment, the first portion 114 of the locking member 112 may be rotatably connected to the connector 94, and the second portion 116 of the locking member 112 may be connected to the locking structure 118. The locking mechanism 110 and/or locking member 112 may be sized and configured to move the locking structure 118 between one or more positions, such as locked and unlocked positions. The connecting member 120 may be sized, shaped, configured, and/or arranged to bias the locking structure 118 into a desired position, such as a locked position. For example, the connecting member 120 may be constructed from a flexible, elastic, and/or resilient material that allows the second portion 116 of the locking member 112 to move relative to the first portion 114 of the locking member 112. The connecting member 120 may be sized and configured to apply a force that tends to move the second portion 116 of the locking member 112 into a desired position, such as the locked position.

Figure 9B:
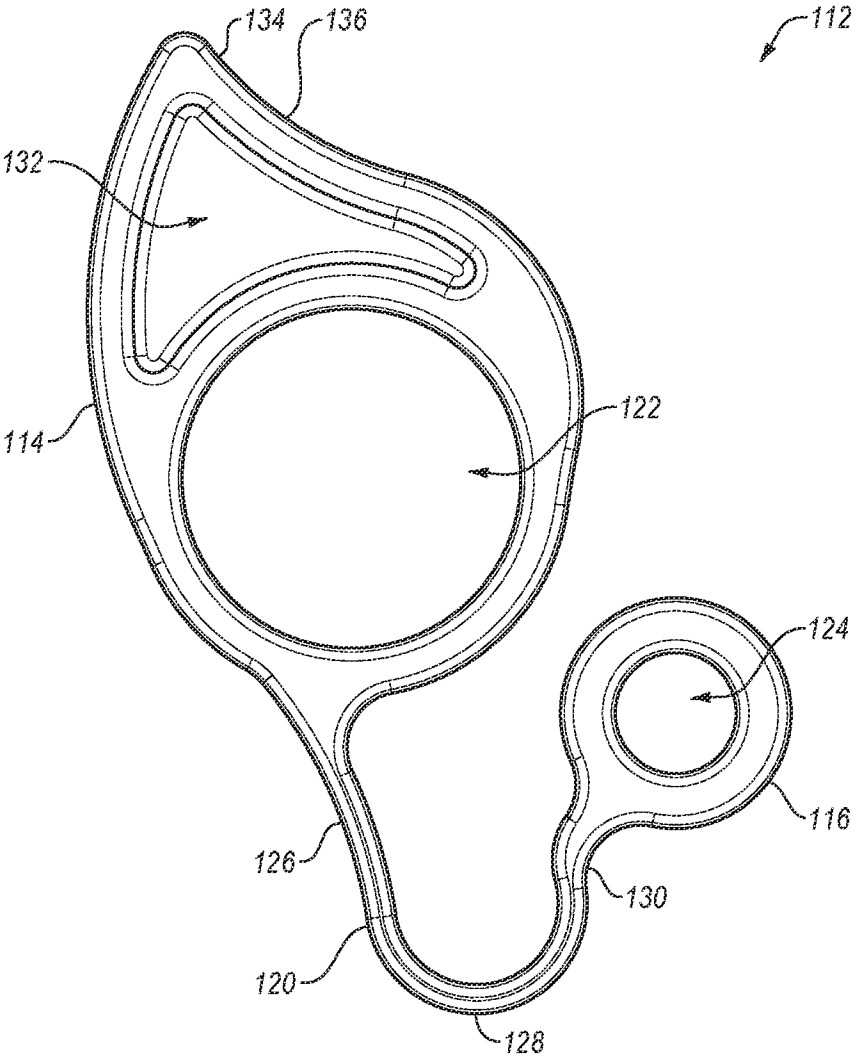
FIG. 9B is a front view of the exemplary locking member shown in FIG. 9A.
Figure 9A:
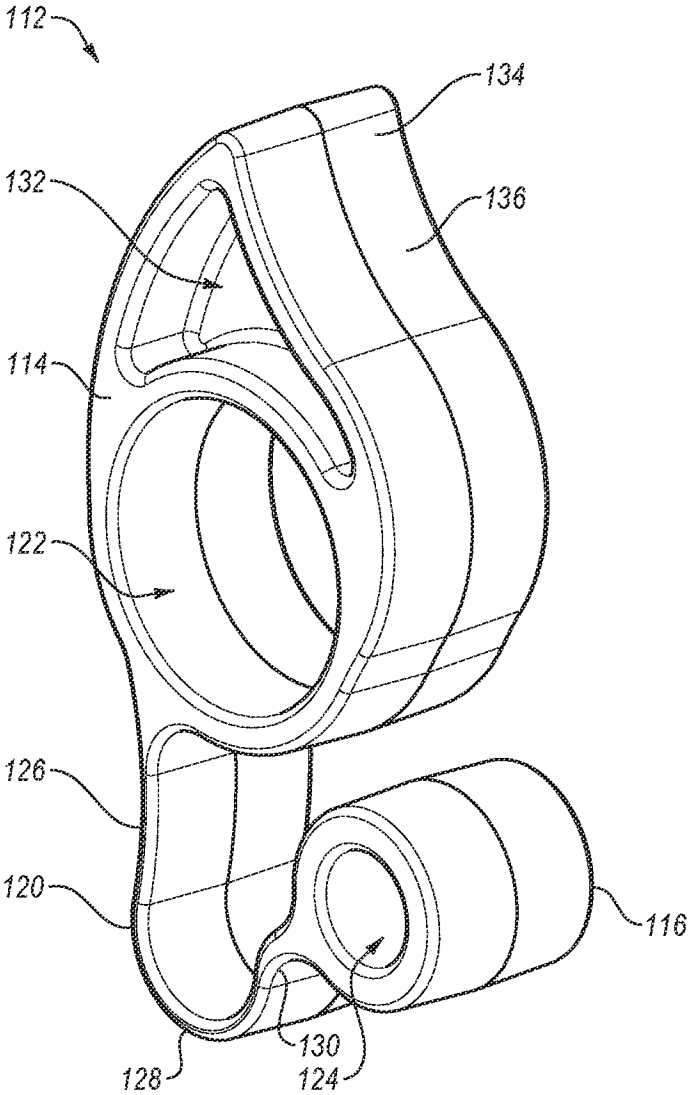
FIG. 9A is a perspective view of an exemplary locking member.
Figure 10A:
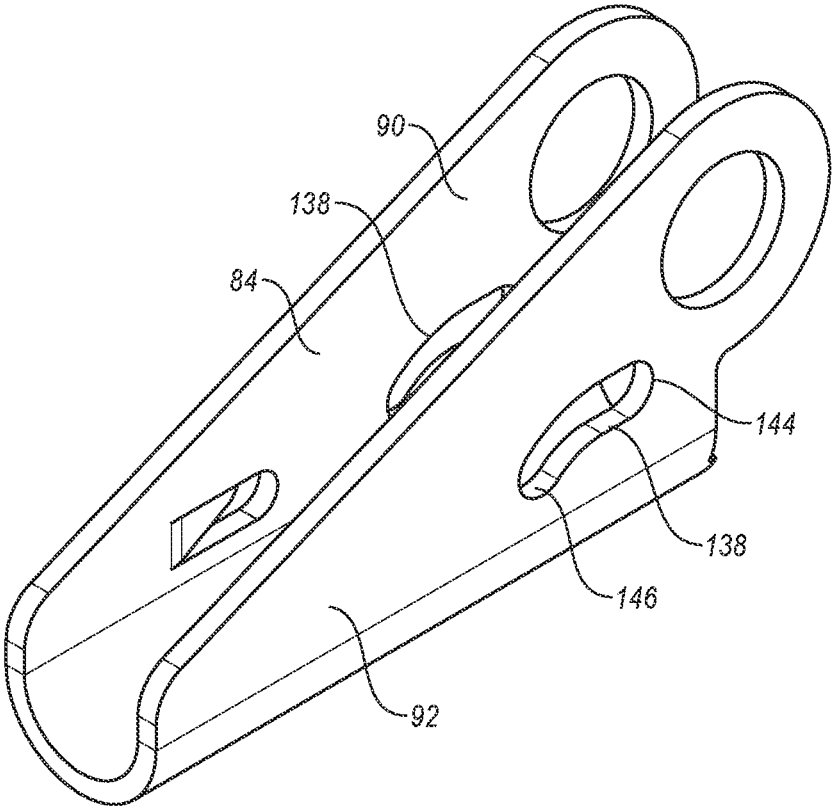
FIG. 10A is a perspective view of a portion of an exemplary hinge assembly.
Figure 10B:
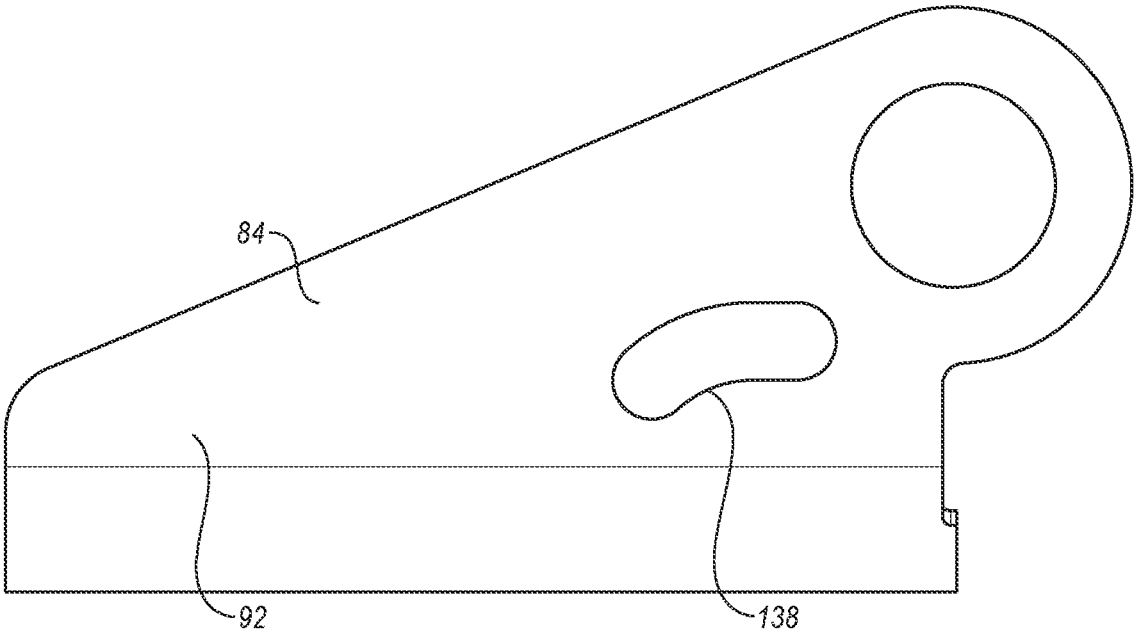
FIG. 10B is a front view of the portion of the exemplary hinge assembly shown in FIG. 10A.
Figure 11A:
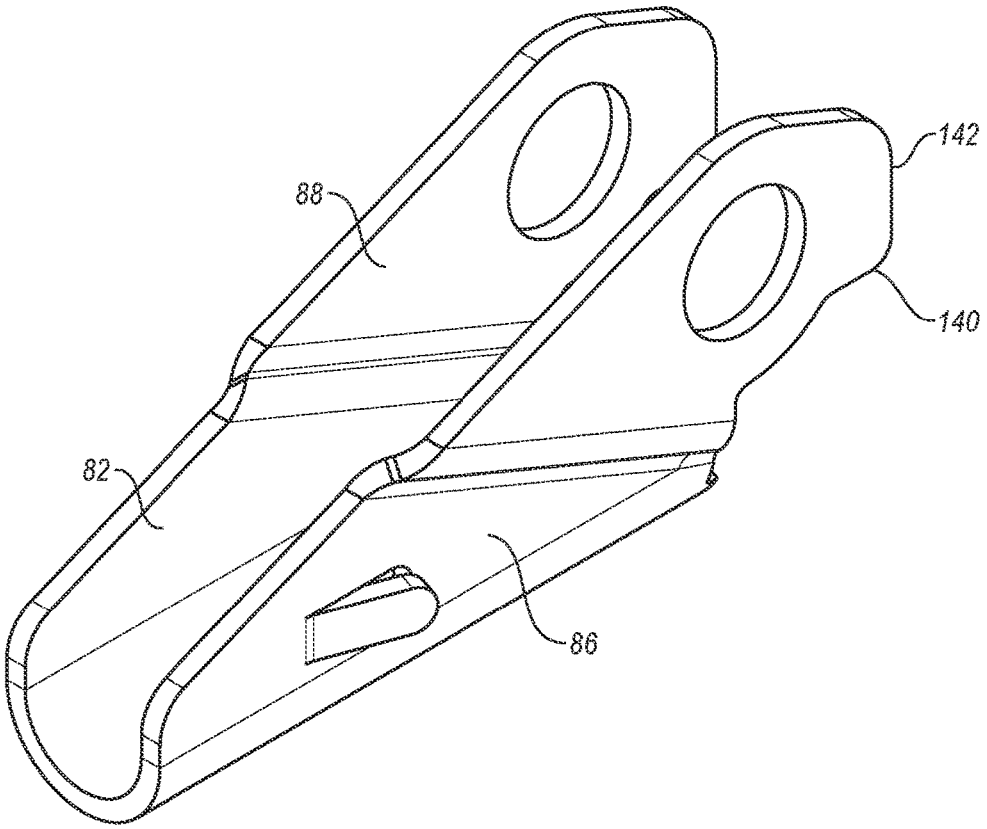
FIG. 11A is a perspective view of a portion of an exemplary hinge assembly.
Figure 11B:
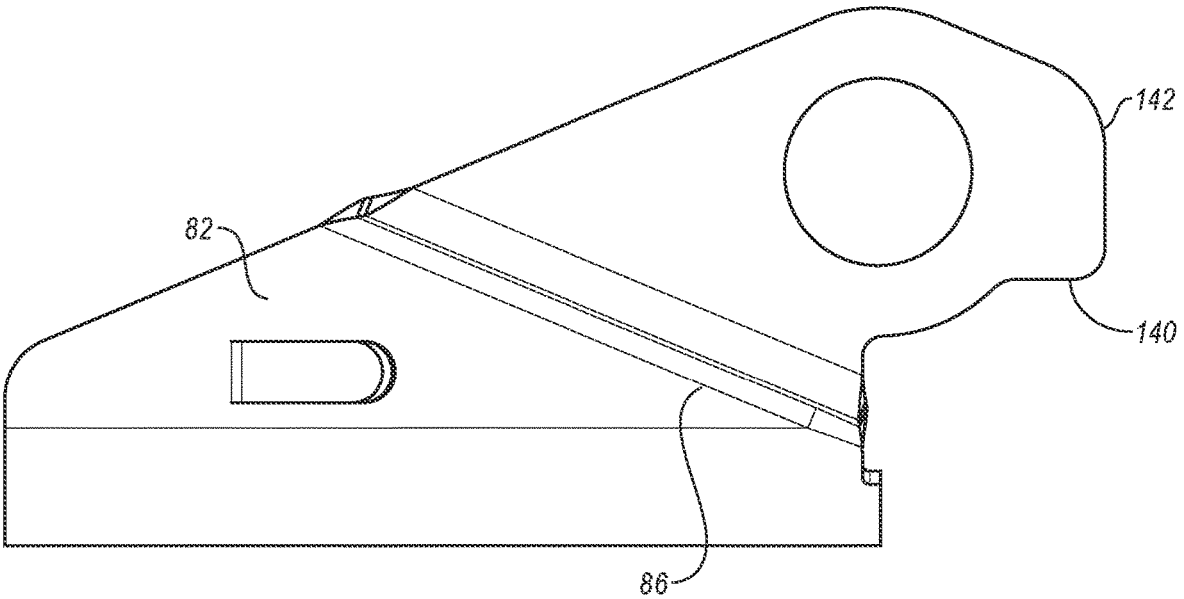
FIG. 11B is a front view of the portion of the exemplary hinge assembly shown in FIG. 11A.

As shown in FIGS. 9A and 9B, for example, the first portion 114 of the locking member 112 may include an aperture 122 that is sized and configured to allow the locking member to be connected to the connector 94. The second portion 116 of the locking member 112 may include an aperture 124 that is sized and configured to allow the locking member to be connected to the locking structure 118. The connecting member 120 may have a curvilinear configuration with one or more curved portions. For example, the connecting member 120 may include a first portion 126, and the first portion 126 may have a slightly bowed or arched configuration. The connecting member 120 may include a second portion 128, and the second portion 128 may have a curled or coiled configuration, such as a generally U-shaped configuration. The connecting member 120 may include a third portion 130, and the third portion may have a curved configuration that extends in a different direction and/or different angle than the first portion 126 and/or the second portion 128. For example, the first portion 126 of the connecting member 120 may be disposed at an angle of about 15 degrees, about 10 degrees, about 5 degrees, or less. The second portion 128 of the connecting member 120 may be disposed in a generally U-shaped configuration, but it could also be disposed in other configurations such as a generally V-shaped configuration, generally W-shaped configuration, etc. The third portion 130 may be disposed at an angle of about 25 degrees, about 30 degrees, about 35 degrees, about 40 degrees, about 45 degrees, about 50 degrees, or more. After reviewing this disclosure, one of ordinary skill in the art will appreciate that the locking mechanism 110 and the locking member 112 may have other suitable shapes, sizes, configurations, and/or arrangements depending, for example, upon the intended use of the table 10.

The locking member 112 may be constructed from relatively sturdy and durable materials such as plastic. The locking member 112 may also be constructed from rather lightweight materials, which may reduce the weight of the table 10. The locking member 112 may also include one or more apertures, such as aperture 132. The aperture 132 may reduce the weight of the locking member 112, and the aperture 132 allow the locking member 112 to be constructed with less material. After reviewing this disclosure, one of ordinary skill in the art will appreciate the locking member 112 may be constructed from other materials with appropriate characteristics.

The locking member 112 may include a control 134, and the control 134 may be used to move or otherwise control the locking member 112. For example, the control 134 may be used to move the locking member 112, such as rotating the first portion 114 of the locking member 112 about the connector 94. The control 134 may extend outwardly from the first portion 114 of the locking member 112, and the control may include a surface 136, such as an engagement or contact surface.

A force or input may be applied to the control 134, such as the engagement surface 136, to lock and/or unlock the locking member 112. For example, when the locking member 112 is in the locked position, a force or input may be required to unlock the locking member 112. For instance, a force greater than the biasing force may be required to unlock the locking member 112. In an exemplary embodiment, a force may be applied to the engagement surface 136 of the control 134, and the force may unlock the locking mechanism 110. In greater detail, a force may be applied to the engagement surface 136 of the control 134 and the first portion 114 of the locking member 112 may rotate in a first direction. The rotation of the first portion 114 of the locking member 112 may cause the second portion 116 of the locking member 112 to move the locking structure 118 between the locked and unlocked positions. When the force is removed from the control 134, or the force is decreased a sufficient, the locking member 112 may be biased to return the locking mechanism 110 into the locked configuration.

As shown in FIGS. 6B and 6C, the locking mechanism 110 may be at least partially disposed between the flanges 86, 88, 90, and/or 92 of the first and second brackets 82, 84 of the first hinge assembly 66. The control 134 may extend outwardly relative to the flanges 86, 88, 90, and/or 92, which may increase access to the engagement surface 136. The positioning of the locking mechanism 110 at least partially between the flanges 86, 88, 90, and/or 92 may help protect the locking mechanism 110 from damage, and may help position the locking member 112 in a desired location or arrangement. After reviewing this disclosure, one of ordinary skill in the art will appreciate that the locking mechanism 110 may be disposed in other positions, and the locking mechanism 110 may have other shapes, sizes, configurations, and/or arrangements.

As discussed above, the locking mechanism 110 may lock the tabletop 12 in an unfolded or use position. The locking mechanism 110 may also unlock the tabletop 12 so that the tabletop 12 is capable of being moved between the use and collapsed positions. In greater detail, the locking mechanism 110 may be sized and configured to lock a hinge assembly, such as the first and/or second hinge assemblies 66, 68, in a fixed position, which may prevent folding of the tabletop 12. While the accompanying figures illustrate the locking mechanism 110 in connection with the first hinge assembly 66, it will be appreciated that the locking member may also be used in connection with the second hinge assembly 68. Further, the table 10 may include any suitable number of locking mechanisms, such as a first locking mechanism used with the first hinge assembly 66 and a second locking member used with the second hinge assembly 68.

As shown in the accompanying figures, the locking structure 118 may be disposed within an opening 138, such as a slot. In particular, the locking structure 118 may be movable within the opening 138. The opening 138 may be disposed in a portion of a hinge assembly, such as the flange 92 of the second bracket 84 of the first hinge assembly 66. The locking structure 118 may be movable within the opening 138 between a first position in which the locking structure locks the hinge assembly 66 and a second position in which the hinge assembly is unlocked. As shown in the accompanying figures, the locking structure 118 may have a generally cylindrical configuration, which may facilitate movement of the locking structure within the opening 138. The locking structure 118 may also have other suitable shapes, sizes, configurations, and arrangements depending, for example, upon the configuration of the hinge assembly 66 and/or the opening 138.

In greater detail, the opening 138 may be disposed in the flange 90 and/or the flange 92 of the second bracket 84. The first bracket 82 may include a receiving portion or engagement surface 140 and a curved or cam surface 142. The engagement surface 140 may be sized and configured to abut, contact, and/or engage the locking structure 118 when the locking structure is in the locked position. The contact between the locking structure 118 and the engagement surface 140 may secure the hinge assembly 66 in a fixed position, and the contact between the locking structure and the engagement surface may prevent the hinge assembly from closing or folding. The cam surface 142 may contact the locking structure 118 when the locking mechanism 110 is disposed in the unlocked position, which may allow the hinge assembly 66 to be opened or closed. The cam surface 142 may help maintain the locking structure 118 in an unlocked position, which may facilitate movement of the hinge assembly 66, and allow folding and/or unfolding of the tabletop 12. Thus, in an exemplary embodiment, when the locking structure 118 of the locking mechanism 110 is in the locked position, the locking structure 118 may contact the engagement surface 140 and that may prevent the hinge assembly 66 from closing. On the other hand, when the locking structure 118 is in the unlocked position, the locking structure 118 may not contact the engagement surface 140 and the hinge assembly 66 may be opened or closed. This may allow the tabletop 12 to be readily moved between the folded and unfolded configurations.

As shown in FIG. 6B, the locking structure 118 may engage the engagement surface 140 to secure the hinge assembly 66 in the open position. In this exemplary configuration, the locking structure 118 may be disposed towards one end of the opening 138, such as a first end 144, and this may be referred to as the locked position because the locking structure 118 may engage the engagement surface 140 to lock the hinge assembly 66 in a fixed position. When the hinge assembly 66 disposed in a fixed position, the tabletop 12 may be disposed in a fixed position, such as the open or use position. As shown FIG. 6C, the locking structure 118 may move within the opening 138. For example, the locking structure 118 may move between the first end 144 of the opening 138 and a second end 146 of the opening. When the locking structure 118 is disposed towards the second end 146 of the opening 138, the locking structure 118 may not abut, contact, and/or engage the engagement surface 140, which may allow the hinge assembly 66 to be moved or closed. This may be referred to as the unlocked position because the locking structure 118 may not engage the engagement surface 140, and this may allow the hinge assembly 66 to be opened or closed. When the locking structure 118 is disposed in the unlocked position, the locking structure may be spaced apart from and/or contact the cam surface 142 when the hinge assembly 66 is being opened or closed. After reviewing this disclosure, one of ordinary skill in the art will appreciate that the locking mechanism 110, the locking member 112, the locking structure 118, the opening 138, the engagement surface 140, the cam surface 142, etc. may have other suitable shapes, sizes, configurations, and arrangements depending, for example, upon the intended use of the table 10.

In operation, the table 10 may be disposed in a folded configuration, such as shown in FIG. 4. The tabletop 12 may be disposed in an unfolded configuration, such as shown in FIG. 3, and the first and second support structures 32, 34 may be moved from the collapsed to the use position, such as shown in FIG. 2. When the tabletop 12 is moved from the folded to unfolded positions, the locking mechanism 110 may automatically lock the tabletop in the unfolded position. For example, as the tabletop 12 is moved from the folded position to the unfolded position, the locking structure 118 may follow the cam surface 142. When the tabletop 12 is in the unfolded position, the locking member 112 may bias the locking structure 118 into a locked position where the locking structure 118 engages the engagement surface 140. Advantageously, the locking mechanism 110 may allow the tabletop 12 to be automatically locked in the unfolded position when the tabletop is moved into the unfolded position. When it is desired to move and/or fold the tabletop 12, a user may apply a force and/or press the control 134, which may cause the locking member 112 to move the locking structure 118 within the opening 138. In particular, the locking member 112 may move the locking structure 118 so that it no longer abuts, contacts, and/or engages the engagement surface 140, which may allow the hinge 66 to rotate and the tabletop 12 to be moved between the unfolded and folded positions, Thus, when the locking structure 118 is no longer disposed in the locked position, the tabletop 12 may be moved between the folded and unfolded positions.

One of ordinary skill in the art may appreciate after reviewing this disclosure that the table 10 and various components, such as the tabletop 12, the support structures 32, 34, the frame 52, the hinge assemblies 66, 68, the cross members 62, 64, the locking mechanism 110, and the like may have other suitable shapes, sizes, configurations, and/or arrangements depending, for example, upon the intended use of the table 10.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A locking mechanism for a folding table, the locking mechanism sized and configured to lock a tabletop in a fixed position, the locking mechanism comprising:

a hinge assembly comprising:

a first bracket including a cam surface and an engagement portion;

a second bracket including an elongated opening; and a connector connecting the first bracket and the second bracket;

a locking member including a first portion, a second portion, and a connecting portion connecting the first portion and the second portion, the first portion, the second portion, and the connecting portion integrally formed as part of a unitary, one-piece structure, the first portion of the locking member connected to the hinge assembly; and a locking structure disposed within the elongated opening in the second bracket of the hinge assembly, the locking structure movable between a locked position and an unlocked position, the locking member sized and configured to bias the locking structure into the locked position.

2. The locking mechanism of claim 1, wherein the first bracket includes one or more flanges;

wherein the second bracket includes one or more flanges;

wherein the cam surface is formed by a portion of the one or more of the flanges of the first bracket; and wherein the engagement surface is formed by a portion of the one or more flanges of the first bracket.

3. The locking mechanism of claim 1, wherein the locking member includes an engaging surface; and wherein a user may apply a force to the engaging surface to unlock the locking mechanism.

4. The locking mechanism of claim 3, wherein the engaging surface of the locking member extends outwardly from the first portion of the locking member; and wherein the locking member rotates about the connector when a force is applied to the engaging surface.

5. The locking mechanism of claim 3, wherein a force applied to the engaging surface rotates the locking member relative to the connector; and wherein rotation of the locking member relative to the connector moves the locking structure from the locked position to the unlocked position.

6. The locking mechanism of claim 1, wherein the locking member biases the locking structure into the locked position.

7. The locking mechanism of claim 1, wherein the connecting portion of the locking member includes an angled portion that is resiliently deformable to allow the locking structure to move between locked and unlocked positions.

8. The locking mechanism of claim 1, wherein the connecting portion of the locking member has a generally U-shaped configuration that is resiliently deformable to allow the locking structure to move between locked and unlocked positions.

9. The locking mechanism of claim 1, wherein the connecting portion of the locking member has a generally U-shaped configuration that is resiliently deformable to allow the locking structure to move between the locked and unlocked positions;

wherein the connecting portion biases the locking structure towards the first portion of the locking member; and wherein rotation of the first portion of the locking member moves the locking structure between the locked and unlocked positions.

10. The locking mechanism of claim 1, wherein the locking member is rotatably connected to the connector.

11. The locking mechanism of claim 1, wherein the first portion of the locking member is rotatably connected to the connector; and wherein the second portion of the locking member is rotatably connected to the locking structure.

12. The locking mechanism of claim 1, wherein the hinge assembly pivotally connects a first section and a second section of the tabletop;

wherein the locking structure engages the engagement surface in the locked position to prevent the hinge assembly from rotating; and wherein the locking structure disengage from the engagement surface in the unlocked position to allow the hinge assembly to rotate.

13. The locking mechanism of claim 1, further comprising a release extending outwardly from the first portion of the locking member; and wherein a force applied to the release rotates the first portion of the locking member and rotation of the first portion of the locking member causes the second portion of the locking member to move the locking structure from the locked position to the unlocked position.

14. The locking mechanism of claim 1, further comprising a release extending outwardly from the locking member;

wherein the locking member is substantially disposed between one or more flanges of the first bracket and one or more flanges of the second bracket; and wherein the release extends beyond an outer surface of the one or more flanges of the first bracket and the one or more flanges of the second bracket.

15. A table comprising:

a tabletop;

a frame connected to the tabletop;

at least one support structure sized and configured to support the tabletop above a surface, the support structure movable between a use position and a collapsed position;

a hinge assembly comprising:

a first bracket connected to a first portion of a tabletop, the first bracket including an engagement surface and a cam surface;

a second bracket connected to a second portion of the tabletop, the second bracket including an opening; and a connector connecting the first bracket and the second bracket;

a locking structure disposed within the opening, the locking structure movable between a locked position where the locking structure engages the engagement surface and an unlocked position where the locking structure is spaced apart from the engagement surface; and a locking member comprising:

a first portion rotatably connected to the connector; and a second portion connected to the locking structure;

wherein rotation of the first portion of the locking member about the connector causes the second portion of the locking member to move the locking structure between locked and unlocked positions.

16. The table of claim 15, wherein the locking member biases the locking structure into the locked position.

17. The table of claim 15, further comprising a release extending from the first portion of the locking member, the release sized and configured to rotate the first portion of the locking member about the connector when a user applies a force to the release.

18. The table of claim 15, wherein the locking member is biased to move the locking structure from the unlocked position to the locked position; and wherein when the tabletop is disposed in an unfolded position, the locking member automatically locks the locking mechanism in the locked position.

19. The table of claim 15, wherein the locking member includes a connecting portion connecting the first portion and the second portion of the locking member, the connecting portion being resiliently deformable to allow the locking structure to move between locked and unlocked positions, the locking member biasing the locking structure into the locked position.

20. A table comprising:

a tabletop including a first portion and a second portion;

a hinge assembly pivotally connecting the first portion and the second portion of the tabletop, the hinge assembly comprising:

a first bracket including a cam surface and an engagement portion;

a second bracket including an elongated opening; and a connector connecting the first bracket and the second bracket;

one or more support structures connected to the tabletop, the support structures sized and configured to support the tabletop above a surface; and a locking mechanism sized and configured to lock the tabletop in a fixed position, the locking mechanism comprising:

a locking member including a first portion, a second portion, and a connecting portion connecting the first portion and the second portion, the first portion, the second portion, and the connecting portion being integrally formed as part of a unitary, one-piece structure, the first portion of the locking member connected to the hinge assembly; and a locking structure disposed within the elongated opening in the second bracket of the hinge assembly, the locking structure connected to the locking member, the locking structure movable between a locked position and an unlocked position, the locking member sized and configured to bias the locking structure into the locked position.

* * * * *